US009082362B2

(12) United States Patent
Bae et al.

(10) Patent No.: US 9,082,362 B2
(45) Date of Patent: Jul. 14, 2015

(54) DISPLAY PANEL AND DISPLAY APPARATUS HAVING THE SAME

(75) Inventors: Yu-Han Bae, Seoul (KR); Jae-Hoon Lee, Seoul (KR); Seung-Hwan Moon, Asan-si (KR)

(73) Assignee: SAMSUNG DISPLAY CO., LTD. (KR)

( * ) Notice: Subject to any disclaimer, the term of this patent is extended or adjusted under 35 U.S.C. 154(b) by 330 days.

(21) Appl. No.: 13/242,379

(22) Filed: Sep. 23, 2011

(65) Prior Publication Data

US 2012/0212401 A1 Aug. 23, 2012

(30) Foreign Application Priority Data

Feb. 23, 2011 (KR) ..... 10-2011-0015965

(51) Int. Cl.
*G09G 3/36* (2006.01)

(52) U.S. Cl.
CPC ..... *G09G 3/3677* (2013.01); *G09G 3/3648* (2013.01); *G09G 2300/0408* (2013.01); *G09G 2300/0426* (2013.01); *G09G 2300/0452* (2013.01); *G09G 2300/0465* (2013.01); *G09G 2310/02* (2013.01); *G09G 2310/0243* (2013.01); *G09G 2310/0251* (2013.01); *G09G 2310/0281* (2013.01); *G09G 2310/0286* (2013.01)

(58) Field of Classification Search
None
See application file for complete search history.

(56) References Cited

U.S. PATENT DOCUMENTS 6,630,920 B1 10/2003 Maekawa et al.
7,639,244 B2 12/2009 Ku et al.
2005/0001805 A1* 1/2005 Jeon et al. ..... 345/92
2005/0179682 A1 8/2005 Shin et al.
2006/0256099 A1 11/2006 Tashiro
2006/0284815 A1 12/2006 Kwon et al.
2007/0097072 A1 5/2007 Kim et al.
2007/0216632 A1* 9/2007 Lee ..... 345/100
2008/0068516 A1 3/2008 Mori et al.
2008/0191980 A1* 8/2008 Jeon ..... 345/87
2008/0204392 A1* 8/2008 Han et al. ..... 345/92

(Continued)

FOREIGN PATENT DOCUMENTS

CN 1784711 A 6/2006
CN 101625838 A 1/2010

(Continued)

OTHER PUBLICATIONS

Extended European Search Report dated Oct. 9, 2012 for European Application No. 11189845.8.

(Continued)

*Primary Examiner* — Temesgh Ghebretinsae
*Assistant Examiner* — Kwin Xie
(74) *Attorney, Agent, or Firm* — Cantor Colburn LLP

(57) ABSTRACT

A display panel includes a display area, a peripheral area which includes a first peripheral area, and a second peripheral area opposite to the first peripheral area, a plurality of pixels in the display area, a plurality of data lines, a first gate line, a second gate line, a first gate driving circuit and a second gate driving circuit. Each data line corresponds to two pixel columns. The first gate line is at a first side of a pixel row. The second gate line is at a second side of the pixel row. The first gate driving circuit is in the first peripheral area and includes a first stage which provides a gate signal to the first gate line. The second gate driving circuit is in a second peripheral area of the display area and includes a second stage which provides a gate signal to the second gate line.

17 Claims, 14 Drawing Sheets

(56) References Cited

U.S. PATENT DOCUMENTS

| | | | | |
|---|---|---|---|---|
| 2008/0211760 | A1 | 9/2008 | Baek et al. | |
| 2008/0218502 | A1 | 9/2008 | Lee et al. | |
| 2009/0021466 | A1 | 1/2009 | Otose et al. | |
| 2010/0110114 | A1 | 5/2010 | Hashimoto | |
| 2010/0156954 | A1 | 6/2010 | Kim et al. | |
| 2010/0177082 | A1* | 7/2010 | Joo et al. | 345/211 |
| 2011/0037746 | A1 | 2/2011 | Kim et al. | |

FOREIGN PATENT DOCUMENTS

| | | | |
|---|---|---|---|
| EP | 2280392 | A1 | 2/2011 |
| KR | 10-0767362 | B1 | 10/2007 |

OTHER PUBLICATIONS

European Search Report dated Jun. 12, 2012 for European Application 11189845.8.

European Examination for European Patent Application No. 11 189 845.8 dated Sep. 10, 2013.

The Extended European Search Report for European Patent Application No. 14150567.7 dated Apr. 4, 2014.

The Extended European Search Report for European Patent Application No. 14191610.6 dated Feb. 25, 2015.

* cited by examiner

DISPLAY PANEL AND DISPLAY APPARATUS HAVING THE SAME

This application claims priority to Korean Patent Application No. 2011-0015965, filed on Feb. 23, 2011, and all the benefits accruing therefrom under 35 U.S.C. §119, the contents of which are herein incorporated by reference in their entireties.

BACKGROUND OF THE INVENTION

1. Field of the Invention

Exemplary embodiments of the invention relate to a display panel and a display apparatus having the display panel. More particularly, exemplary embodiments of the invention relate to a display panel which improves an appearance quality and a display apparatus having the display panel.

2. Description of the Related Art

Generally, a liquid crystal display ("LCD") apparatus includes an LCD panel and a driving device driving the LCD panel. The LCD panel includes a plurality of data lines, and a plurality of gate lines crossing the data lines. Thus, a plurality of pixels of the LCD panel may be defined by the data lines and the gate lines. The driving device includes a gate driving circuit outputting a gate signal to a gate line and a data driving circuit outputting a data signal to a data line.

In order to decrease a total size of the LCD apparatus and a manufacturing cost, a pixel structure capable of decreasing the number of data lines and the number of data driving circuits has been used. Two pixels adjacent to each other share one data line in the pixel structure. Thus, a plurality of pixels included in two pixel columns shares one data line so that the number of data lines is decreased. However, a plurality of pixels included in one pixel row is electrically connected to two gate lines adjacent to each other, and two gate signals different from each other are applied to two gate lines.

Two gate lines are necessary to drive the pixel row, so that two circuit stages generating two gate signals is formed in a peripheral area of the LCD panel corresponding to the pixel row in a display area of the LCD panel. Thus, a width of the peripheral area is increased so that a bezel width is increased.

In addition, in a high resolution LCD panel, a delay difference of a gate signal occurs by a resistance of a gate line so that pixels at left and right sides of the LCD panel have a charge difference by the delay difference. In result, a defect such as a vertical line occurs.

BRIEF SUMMARY OF THE INVENTION

Exemplary embodiments of the invention provide a display panel capable of decreasing a bezel width of a display apparatus.

Exemplary embodiments of the invention also provide a display apparatus having the display panel.

According to an exemplary embodiment of the invention, a display panel includes a display area, a peripheral area which surrounds the display area and includes a first peripheral area, and a second peripheral area opposite to the first peripheral area, a plurality of pixels, a plurality of data lines, a first gate line, a second gate line, a first gate driving circuit and a second gate driving circuit. The pixels are in the display area, and include a plurality of pixel rows and a plurality of pixel columns. The data lines extend in a column direction and each data line corresponds to two pixel columns. The first gate line extends in a row direction and is at a first side of each of pixel rows. The second gate line extends in the row direction and is at a second side of each of the pixel rows. The first gate driving circuit is in the first peripheral area and includes a first stage which provides a gate signal to the first gate line. The second gate driving circuit is in the second peripheral area and includes a second stage which provides the gate signal to the second gate line.

In an exemplary embodiment, the display panel further may include a first clock line which transmits a first clock signal to the first gate driving circuit, a third clock line which transmits a third clock signal to the second gate driving circuit, the third clock signal having a first delay difference with respect to the first clock signal, a second clock line which transmits a second clock signal to the first gate driving circuit, the second clock signal having a second delay difference with respect to the first clock signal, the second delay difference being larger than the first delay difference, and a fourth clock line which transmits a fourth clock signal to the second gate driving circuit, the fourth clock signal having a third delay difference with respect to the first clock signal, the third delay difference being larger than the second delay difference.

In an exemplary embodiment, the first stage may be in the first peripheral area and has a width smaller than or equal to a pixel row width defined by a distance between the first and second gate lines, and the second stage may be in the second peripheral area and has a width smaller than or equal to the pixel row width.

In an exemplary embodiment, the display panel further may include a first discharging circuit adjacent to the second stage, and including a first discharging transistor which discharges a high voltage applied to the first gate line to a low voltage, and a second discharging circuit adjacent to the first stage, and including a second discharging transistor which discharges a high voltage applied to the second gate line to a low voltage.

In an exemplary embodiment, the pixels may include a plurality of red pixels, a plurality of green pixels and a plurality of blue pixels, one of the first and second gate lines may be electrically connected to each of the red pixels and the other may be electrically connected to each of the green pixels, and each of the first and second gate lines may be electrically connected to the blue pixels.

According to another exemplary embodiment of the invention, a display apparatus a display panel and a printed circuit board ("PCB"). The display panel includes a display area, a peripheral area which surrounds the display area and includes a first peripheral area, and a second peripheral area opposite to the first peripheral area, a plurality of pixels in the display area and including a plurality of pixel rows and a plurality of pixel columns, a plurality of data lines which extend in a column direction and each data line corresponds to two pixel columns, a first gate line which extends in a row direction and is at a first side of each of pixel rows, a second gate line which extends in the row direction and is at a second side of each of the pixel rows, a first gate driving circuit in the first peripheral area including a first stage which provides a gate signal to the first gate line, and a second gate driving circuit in the second peripheral area and including a second stage providing the gate signal to the second gate line. The PCB is electrically connected to the display panel and has a main driving circuit on PCB. The main driving circuit generates a first clock signal, a second clock signal, a third clock signal and a fourth clock signal which are provided to the first and second gate driving circuits.

In an exemplary embodiment, the printed circuit board may include a plurality of first signal lines which transmits the first and second clock signals to the first gate driving circuit, a plurality of second signal lines which transmits the third and fourth clock signals to the second gate driving circuit and a resistor-capacitor ("RC") control part controlling a RC time constant of the first and second signal lines.

According to the invention, one of the first and second gate driving circuits provides the gate signal to the gate line at the first side of the pixel row, and the other provides the gate signal to the gate line at the second side of the pixel row, so that the bezel width may be decreased and an electric power consumption may be decreased in a high resolution display apparatus. In addition, by the pixel structure of the invention, the significant difference according to the delay difference of the gate signals may be prevented.

BRIEF DESCRIPTION OF THE DRAWINGS

The above and other features of the invention will become more apparent by describing in detailed exemplary embodiments thereof with reference to the accompanying drawings, in which.

DETAILED DESCRIPTION OF THE INVENTION

Figure 1:
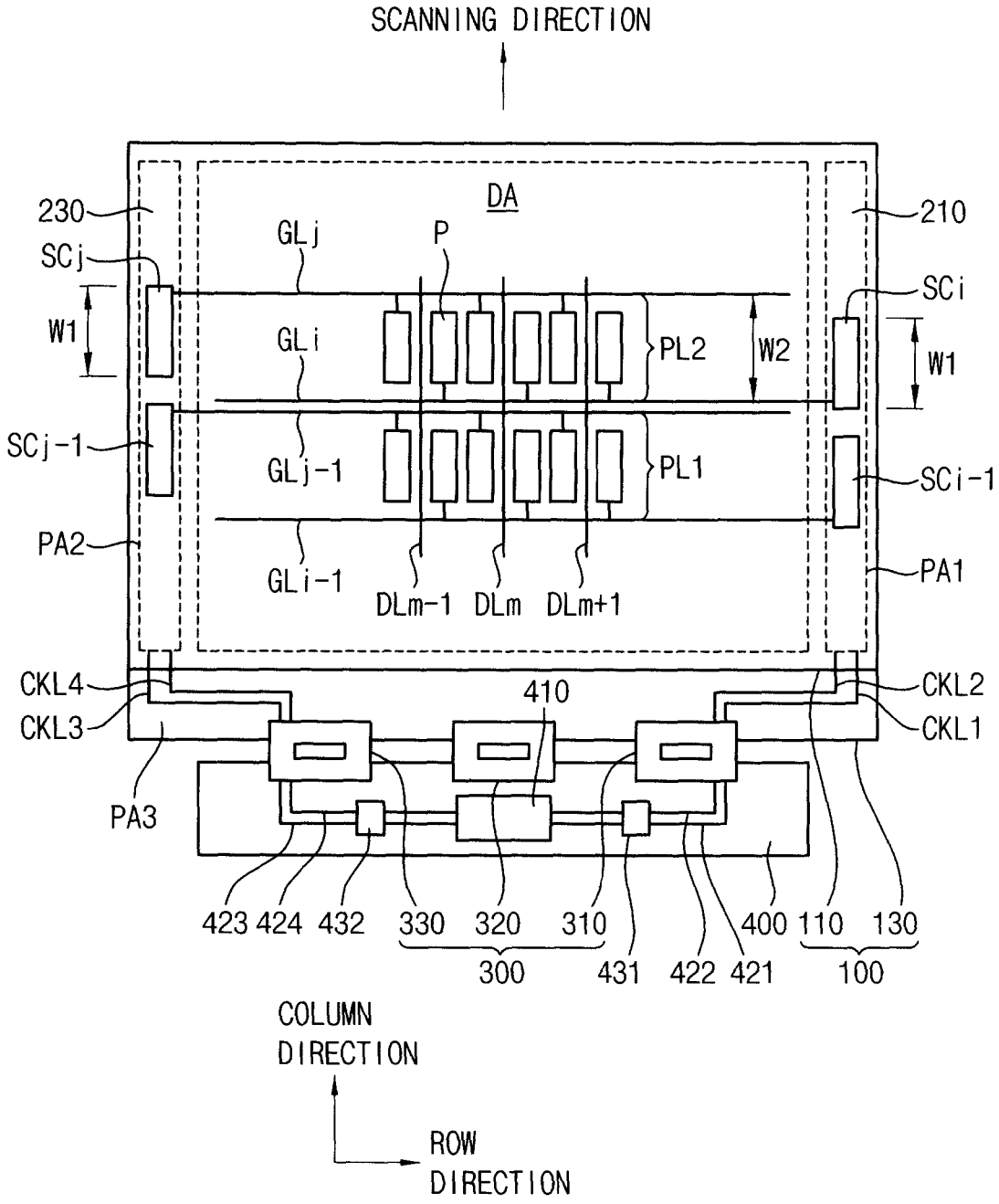
FIG. 1 is a plan view illustrating an exemplary embodiment of a display apparatus according to the invention.

The invention is described more fully hereinafter with reference to the accompanying drawings, in which exemplary embodiments of the invention are shown. This invention may, however, be embodied in many different forms and should not be construed as limited to the exemplary embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity.

It will be understood that when an element or layer is referred to as being "on" or "connected to" another element or layer, the element or layer can be directly on or connected to another element or layer or intervening elements or layers. In contrast, when an element is referred to as being "directly on" or "directly connected to" another element or layer, there are no intervening elements or layers present. Like numbers refer to like elements throughout. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

Spatially relative terms, such as "lower," "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the invention will be explained in detail with reference to the accompanying drawings.

FIG. 1 is a plan view illustrating an exemplary embodiment of a display apparatus according to the invention.

Referring to FIG. 1, the display apparatus includes a display panel 100, a data driving part 300 and a printed circuit board ("PCB") 400.

The display panel 100 may include a display area DA, and a peripheral area PA surrounding the display area DA. In the display area DA are a plurality of data lines DLm−1, DLm and DLm+1, a plurality of gate lines GLi−1, GLj−1, GLi and GLj, and a plurality of pixels P (wherein, m, i and j are a natural number).

The data lines DLm−1, DLm and DLm+1 longitudinally extend in a column direction and arranged in a row direction, and each of the data lines DLm−1, DLm and DLm+1 corresponds to two pixel columns.

The gate lines GLi−1, GLj−1, GLi and GLj longitudinally extend in the row direction and arranged in the column direction (wherein, i and j are a natural number). In one exemplary embodiment, for example, the gate line GLi−1 or GLi is at a first side of each of pixel rows and the gate line GLj−1 or GLj is at a second side of each of the pixel rows opposite to the first side.

Each of the pixels P includes a pixel switching element, and a pixel electrode electrically connected to the pixel switching element. The pixels may be arranged as a matrix type including a plurality of pixel columns and a plurality of pixel rows. Two pixel columns may be disposed between the data lines DLm−1 and DLm adjacent to each other. One pixel row may be disposed between two gate lines adjacent to each other. The pixels of the pixel row may be electrically connected to two gate lines.

The peripheral area PA may include a first gate driving circuit 210, a second gate driving circuit 230 and the data driving part 300.

The first gate driving circuit 210 is in a first peripheral area PA1 and includes a plurality of stages SCi−1 and SCi cascade-connected to each other. The first gate driving circuit 210 is physically and/or electrically connected to the first clock line CKL1 and a second clock line CKL2 in the first peripheral area PA1. The first gate driving circuit 210 includes a plurality of circuit switching elements, and may be formed via substantially the same process used in forming the pixel switching element. The first gate driving circuit 210 is electrically connected to a first gate line at the first side (upper side) of the pixel row along a scanning direction of two gate lines electrically connected to the pixels of the pixel row, and generates a gate signal synchronized with a first clock signal CK1 applied to the first clock line CKL1 or a second clock signal CK2 applied to the second clock line CKL2.

In one exemplary embodiment, for example, an (i−1)-th stage SCi−1 is connected to an (i−1)-th gate line GLi−1 at the first side of a first pixel row PL1, and a width W1 of the (i−1)-th stage SCi−1 may be smaller than or equal to a width W2 of the first pixel row PL1. An i-th stage SCi is connected to an i-th gate line GLi at the first side of a second pixel row PL2, and the width W1 of the i-th stage SCi may be smaller than or equal to the width W2 of the second pixel row PL2.

The second gate driving circuit 230 is in a second peripheral area PA2, and includes a plurality of stages SCj−1 and SCj cascade-connected to each other. The second gate driving circuit 230 is connected to a third clock line CKL3 and a fourth clock line CKL4 in the second peripheral area PA2. The second gate driving circuit 230 includes a plurality of circuit switching elements and may be formed via substantially the same process used in forming the pixel switching element. The second gate driving circuit 230 is electrically connected to a second gate line at the second side (lower side) of the pixel row along the scanning direction of two gate lines electrically connected to the pixels of the pixel row, and generates the gate signal synchronized with a third clock signal CK3 applied to the third clock line CKL3 or a fourth clock signal CK4 applied to the fourth clock line CKL4.

In one exemplary embodiment, for example, a (j−1)-th stage SCj−1 is connected to a (j−1)-th gate line GLj−1 at the second side of the first pixel row PL1, and a width W1 of the (j−1)-th stage SCj−1 may be smaller than or equal to a width W2 of the first pixel row PL1. A j-th stage SCj is connected to a j-th gate line GLj at the second side of the second pixel row PL2, and the width W1 of the j-th stage SCj may be smaller than or equal to the width W2 of the second pixel row PL2. The width W2 may be defined as a distance between the (i−1)-th gate line GLi−1 and the (j−1)-th gate line GLj−1 or between the i-th gate line GLi and the j-th gate line GLj, taken in the same (column) direction.

The data driving part 300 is in a third peripheral area PA3. The data driving part 300 includes a plurality of data driving circuits 310, 320 and 330, and each of the data driving circuits 310, 320 and 330 may include a flexible PCB on which a data driving chip is mounted.

The PCB 400 may be electrically connected to the display panel 100 via the data driving part 300. The PCB 400 includes a main driving circuit 410 and a plurality of signal lines 421, 422, 423 and 424. The main driving circuit 410 generates the first, second, third and fourth clock signals CK1, CK2, CK3 and CK4 and is on the PCB 400.

The signal lines 421, 422, 423 and 424 transmit the first, second, third and fourth clock signals CK1, CK2, CK3 and CK4 to the first and second gate driving circuit 210 and 230, respectively. In one exemplary embodiment, for example, first signal lines 421 and 422 are electrically connected to the first and second clock lines CKL1 and CKL2 in the first peripheral area PA1 via a first data driving circuit 330. Second signal lines 423 and 424 are electrically connected to the third and fourth clock lines CKL3 and CKL4 in the second peripheral area PA2 via a last data driving circuit 330.

The PCB 400 may further include a first resistor-capacitor ("RC") control part 431 and a second RC control part 432.

The first and second RC control parts 431 and 432 control a RC time constant value of the first and second signal lines 421, 422, 423 and 424. The first signal lines 421 and 422 transmit the first and second clock signals CK1 and CK2, and the second signal lines 423 and 424 transmit the third and fourth clock signals CK3 and CK4. In one exemplary embodiment, for example, when the RC time constant value of the first signal lines 421 and 422 is different from the RC time constant value of the second signal lines 423 and 424, the first RC control parts 431 controls the RC time constant of the first signal lines 421 and 422 and the second RC control parts 432 controls the RC time constant of the second signal lines 423 and 424 so that the RC time constant value of the first signal lines 421 and 422 is substantially the same as the RC time constant value of the second signal lines 423 and 424. Thus, a delay difference between the gate signal generated from the first gate driving circuit 210 and the gate signal generated from the second gate driving circuit 230 may be reduced or effectively prevented.

The display panel 100 includes a display substrate 110, an opposing substrate 130 opposite to the display substrate 110, and a liquid crystal layer (not shown) between the display substrate 110 and the opposing substrate 130.

The display substrate 110 includes a first base substrate having the display area DA and the peripheral area PA, and the data lines DLm−1, DLm and DLm+1, the gate lines GLi−1, GLj−1, GLi and GLj and the pixel electrodes are in the display area DA of the first base substrate. The first and second gate driving circuits 210 and 230 are in the first and second peripheral areas PA1 and PA2 of the first base substrate.

The opposing substrate 130 includes a second base substrate opposite to the first base substrate, and the second base substrate has the display area DA and the peripheral areas PA1, PA2 and PA3.

A plurality of color filters (not shown) is in the display area DA of the second base substrate. The color filters may include red, green and blue color filters. A common electrode (not shown) is on the second base substrate including the color filters, and the common electrode is opposite to (e.g., faces) the pixel electrodes. In an alternative embodiment, the color filters may be included in the display substrate 110. In addition, the common electrode may be included in the display substrate 110.

Figure 2A:
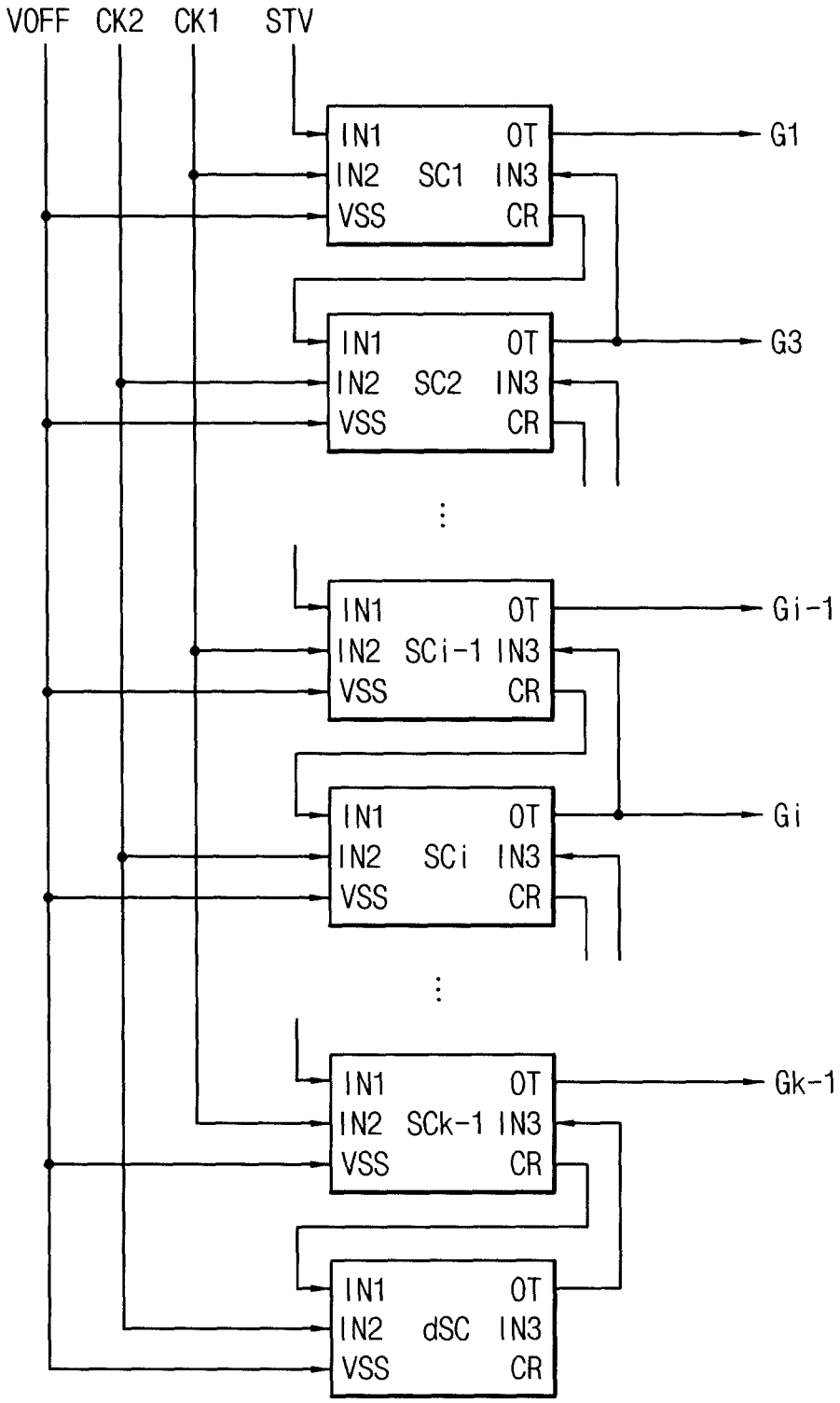
FIG. 2A is a block diagram illustrating an exemplary embodiment of a first gate driving circuit of FIG. 1.
Figure 2B:
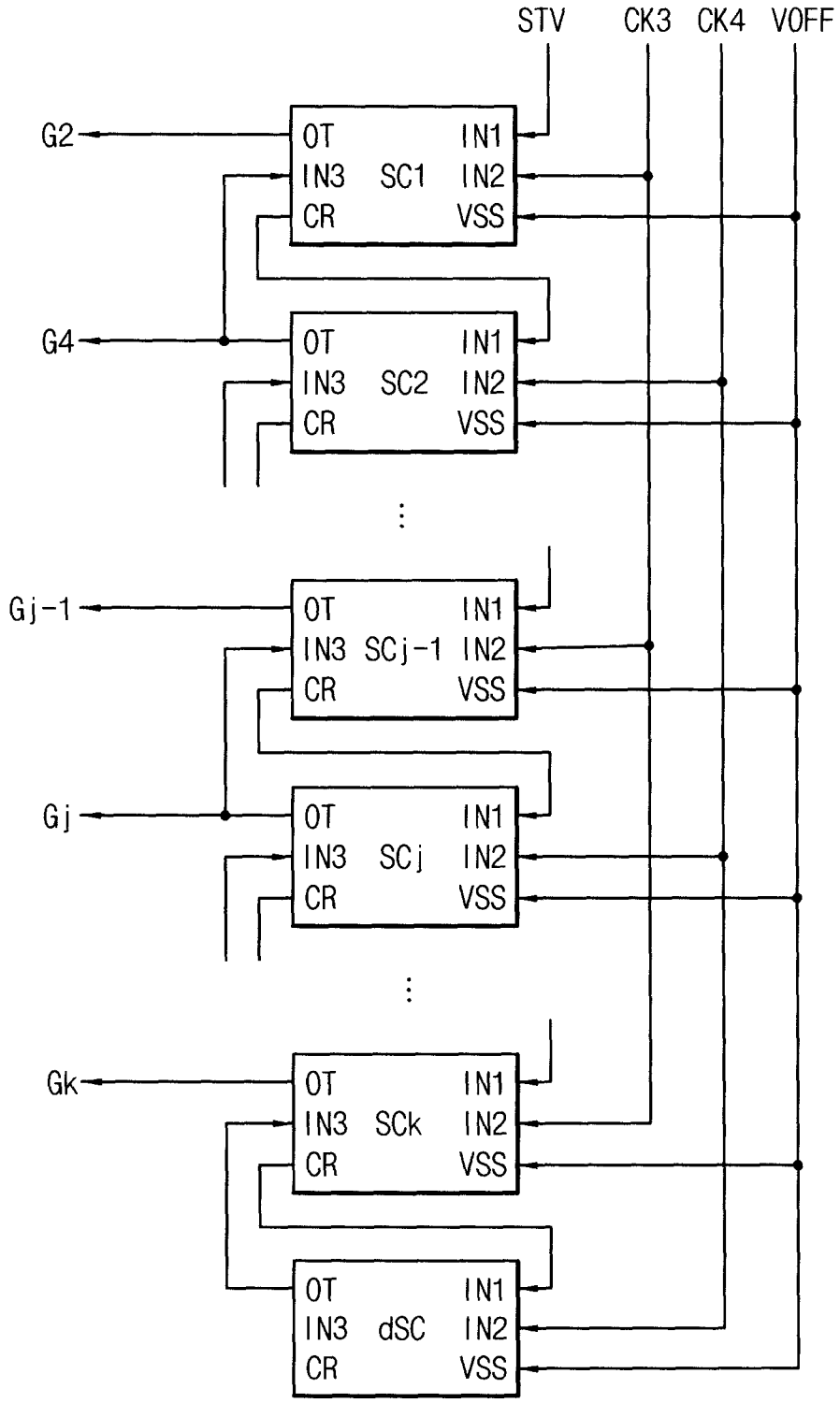
FIG. 2B is a block diagram illustrating an exemplary embodiment of a second gate driving circuit of FIG. 1.
Figure 3:
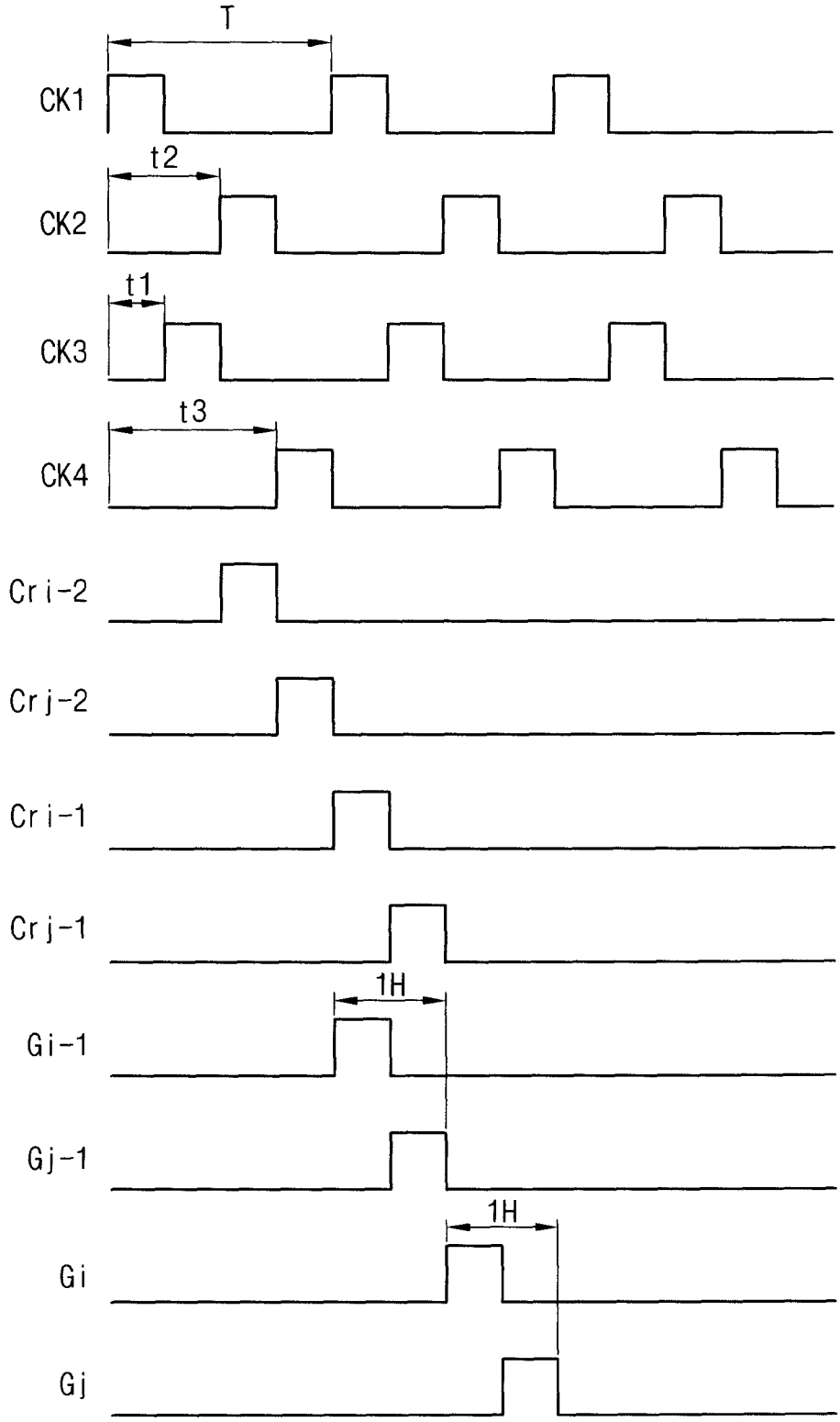
FIG. 3 is a waveform diagram illustrating an exemplary embodiment of input and output signals of the first and second gate driving circuits of FIGS. 2A and 2B.

FIG. 2A is a block diagram illustrating an exemplary embodiment of the first gate driving circuit 210 of FIG. 1. FIG. 2B is a block diagram illustrating the second gate driving circuit 230 of FIG. 1. FIG. 3 a waveform diagram illustrating an exemplary embodiment of input and output signals of the first and second gate driving circuits 210 and 230 of FIGS. 2A and 2B.

Referring to FIGS. 2A and 3, the first gate driving circuit 210 includes a plurality of stages SC1, SC2, . . . , SCi−1, SCi, . . . , SCk−1, dSC, and receives a vertical start signal STV, a low voltage VOFF, the first clock signal CK1 and the second clock signal CK2. The second clock signal CK2 may have a second delay difference t2 with respect to the first clock signal CK1.

Each of the stages SC1, SC2, . . . , SCi−1, SCi, . . . , SCk−1, dSC may include a first input terminal IN1, a second input terminal IN2, a third input terminal IN3, a voltage terminal VSS, an output terminal OT and a carry terminal CR. The first input terminal N1 receives the vertical start signal STV or a carry signal of at least one of previous stages. The second input terminal IN2 receives the first clock signal CK1 or the second clock signal CK2. The third input terminal IN3 receives a gate signal of at least one of following stages. The voltage terminal VSS receives the low voltage VOFF that is a low level of the gate signal. The output terminal OT outputs the gate signal synchronized with the first or second clock signal CK1 or CK2. The carry terminal CR outputs a carry signal synchronized with the gate signal.

In one exemplary embodiment, for example, an (i−1)-th stage SCi−1 is driven in response to a high voltage VON of a carry signal Cri−2 outputted from the previous stage that is an (i−2)-th stage, to generate an (i−1)-th gate signal Gi−1 synchronized with the first clock signal CK1. The (i−1)-th gate signal Gi−1 is applied to an (i−1)-th gate line GLi−1 at the first side of the first pixel row PL1. An i-th stage SCi is driven in response to the high voltage VON of a carry signal Cri−1 outputted from the previous stage that is the (i−1)-th stage, to generate an i-th gate signal Gi synchronized with the second clock signal CK2. The i-th gate signal Gi is applied to an i-th gate line GLi at the first side of the second pixel row PL2.

Accordingly, the first gate driving circuit 210 sequentially outputs the gate signals G1, G3, . . . , Gi−1, Gi, . . . , Gk−1 based on the first clock signal CK1 or the second clock signal CK2 (wherein, k is a natural number).

Referring to FIGS. 2B and 3, the second gate driving circuit 230 includes a plurality of stages SC1, SC2, . . . , SCj−1, SCj, . . . , SCk, dSC, and receives the vertical start signal STV, a low voltage VOFF, the third clock signal CK3 and the fourth clock signal CK4. The third clock signal CK3 may have a first delay difference t1 with respect to the first clock signal CK1. The first delay difference t1 is smaller than the second delay difference t2. The fourth clock signal CK4 may have a third delay difference t3 with respect to the first clock signal CK1. The third delay difference t3 is larger than the second delay difference t2. The first, second, third and fourth clock signals CK1, CK2, CK3 and CK4 may be repeated by one period T, and each of the first, second, third or fourth clock signal CK1, CK2, CK3 or CK4 has a high period corresponding to ¼T.

Each of the stages SC1, SC2, . . . , SCj−1, SCj, . . . , SCk, dSC may include the first input terminal N1, the second input terminal IN2, the third input terminal IN3, the voltage terminal VSS, the output terminal OT and the carry terminal CR. The first input terminal N1 receives the vertical start signal STV or a carry signal of at least one of previous stages. The second input terminal IN2 receives the third clock signal CK3 or the fourth clock signal CK4. The third input terminal IN3 receives a gate signal of at least one of following stages. The voltage terminal VSS receives the low voltage VOFF that is the low level of the gate signal. The output terminal OT outputs a gate signal synchronized with the third or fourth clock signal CK3 or CK4. The carry terminal CR outputs the carry signal synchronized with the gate signal.

In one exemplary embodiment, for example, a (j−1)-th stage SCj−1 is driven in response to a high voltage VON of a carry signal Crj−2 outputted from the previous stage that is a (j−2)-th stage, to generate a (j−1)-th gate signal Gj−1 synchronized with the third clock signal CK3. The (j−1)-th gate signal Gj−1 is applied to a (j−1)-th gate line GLj−1 at the second side of the first pixel row PL1. A j-th stage SCj is driven in response to the high voltage VON of a carry signal Crj−1 outputted from the previous stage that is the (j−1)-th stage, to generate a j-th gate signal Gj synchronized with the fourth clock signal CK4. The j-th gate signal Gj is applied to a j-th gate line GLj at the second side of the second pixel row PL2.

Accordingly, the second gate driving circuit 230 sequentially outputs the gate signals G2, G4, . . . , Gj−1, Gj, . . . , Gk in response to the third signal CK3 or the fourth clock signal CK4.

The first and second gate driving circuits 210 and 230 may sequentially output the gate signals G1, G2, . . . , Gi−1, Gj−1, Gi, Gj, . . . , Gk to the gate lines of the display panel 100.

Figure 4:
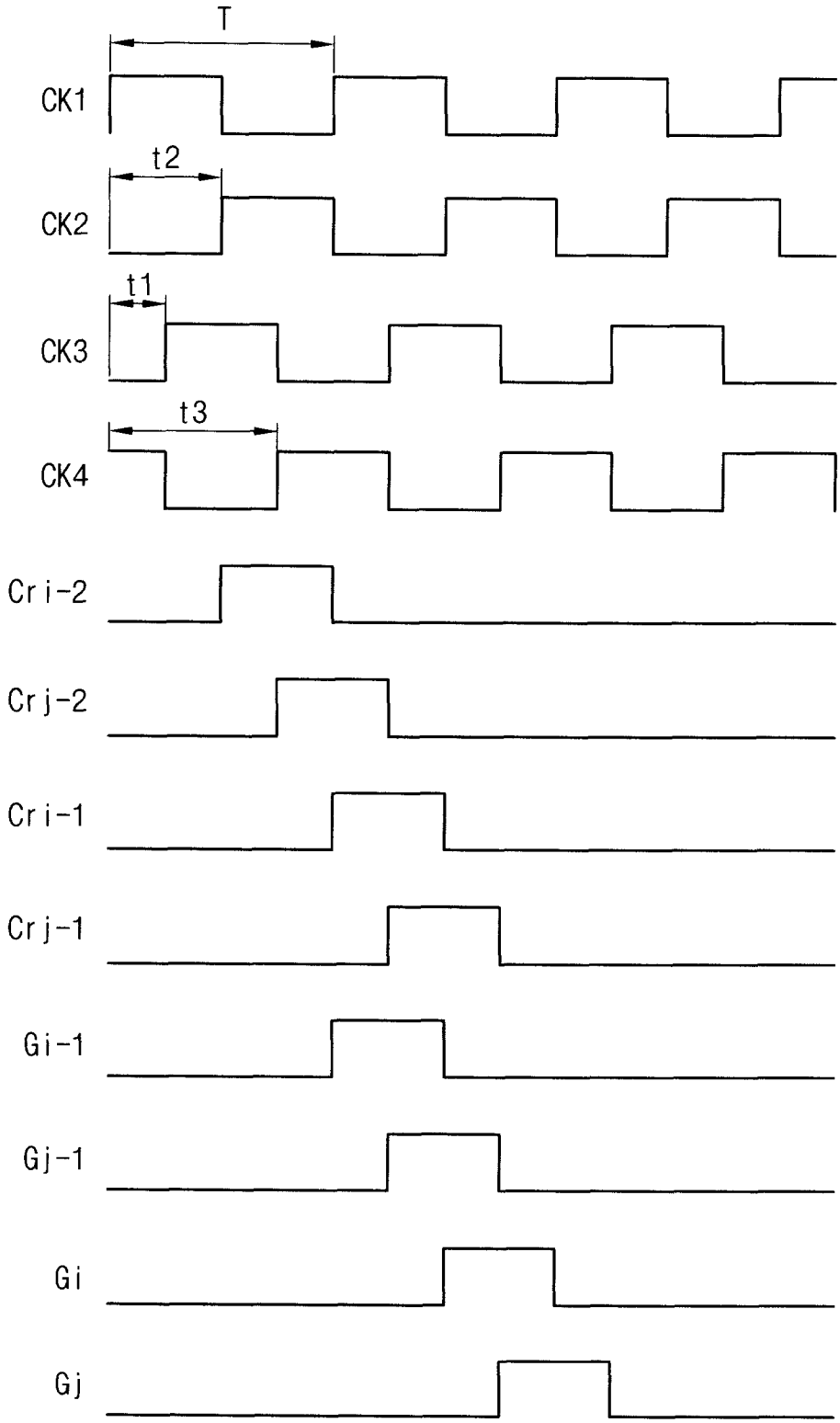
FIG. 4 is a waveform diagram illustrating another exemplary embodiment of input and output signals of first and second gate driving circuits according to the invention.

FIG. 4 is a waveform diagram illustrating another exemplary embodiment of input and output signals of first and second gate driving circuits according to the invention.

Referring to FIGS. 1 and 4, the first clock signal CK1 and the second clock signal CK2 are applied to the first gate driving circuit 210. The third clock signal CK3 and fourth clock signal CK4 are applied to the second gate driving circuit 230.

The third clock signal CK3 has the first delay difference t1 with respect to the first clock signal CK1, the second clock signal CK2 has the second delay difference t2 larger than the first delay difference t1 with respect to the first clock signal CK1, and the fourth clock signal CK4 has the third delay difference t3 larger than the second delay difference t2 with respect to the first clock signal CK1.

The first, second, third and fourth clock signals CK1, CK2, CK3 and CK4 may be repeated by one period T, and each of the first, second, third or fourth clock signal CK1, CK2, CK3 or CK4 has a high period corresponding to ½T.

When the high period of each of the first, second, third or fourth clock signal CK1, CK2, CK3 or CK4 is substantially the same as ½T, the high period of the third clock signal CK3 overlaps with a half of the high period of the first clock signal CK1, the high period of the second clock signal CK2 overlaps with a half of the high period of the third clock signal CK3, and the high period of the fourth clock signal CK4 overlaps with a half of the high period of the second clock signal CK2. The first clock CK1 may have a phase opposite to a phase of the second clock CK2. The third clock CK3 may have a phase opposite to a phase of the fourth clock CK4.

When the high period of each of the clock signals is ½T, an overlapping period is ½T. However, when the high period of each of the clock signals is smaller than ½T, the overlapping period may be smaller than ½T.

Referring to FIGS. 2A, 2B and 4, a method of driving the first and second gate driving circuits 210 and 230 is substantially the same as those described in the previous exemplary embodiment, so that any repetitive detailed explanation will be simplified. The (i−1)-th stage SCi−1 of the first gate driving circuit 210 outputs the (i−1)-th carry signal Cri−1 and the (i−1)-th gate signal Gi−1 synchronized with the high period of the first clock signal CK1. The i-th stage SCi is driven in response to the (i−1)-th carry signal Cri−1 to output the i-th carry signal Cri and the i-th gate signal Gi synchronized with the high period ½T of the second clock signal CK2.

The (j−1)-th stage SCj−1 of the second gate driving circuit 230 outputs the (j−1)-th carry signal Crj−1 and the (j−1)-th gate signal Gj−1 synchronized with the high period of the third clock signal CK3. The j-th stage SCj is driven in response to the (j−1)-th carry signal Crj−1 to output the j-th carry signal Crj and the j-th gate signal Gj synchronized with the high period ½T of the fourth clock signal CK4.

Figure 5:
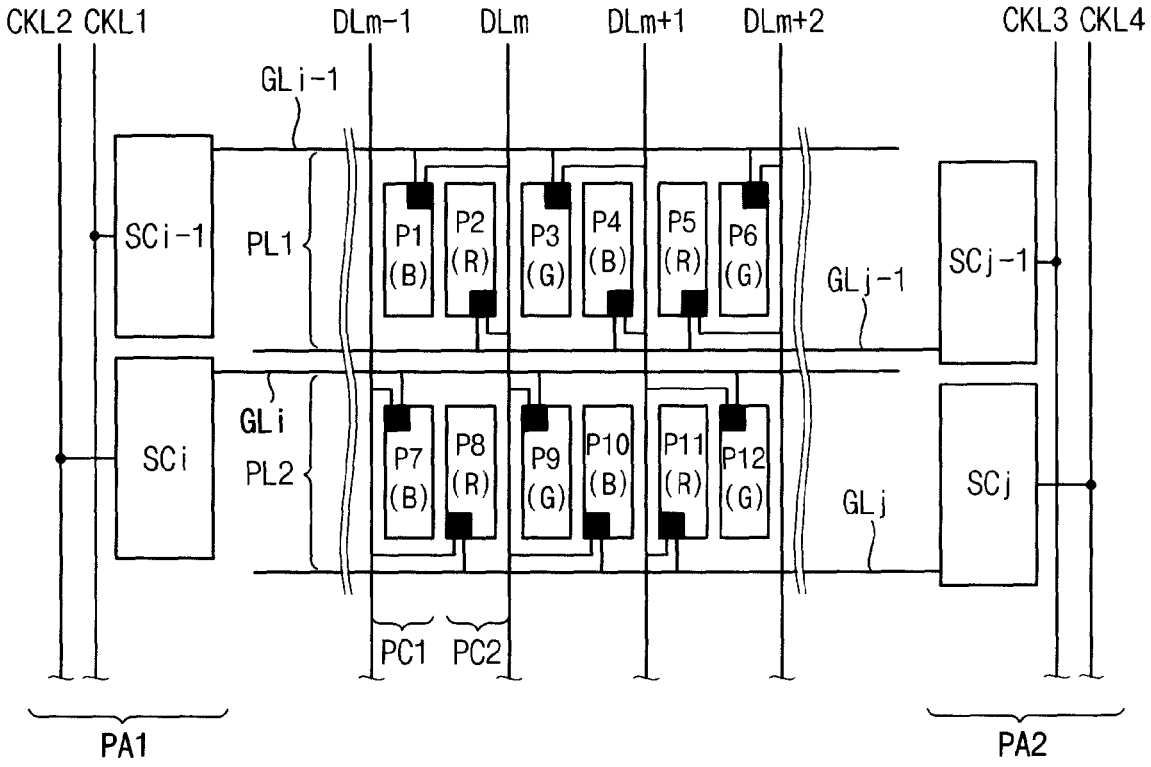
FIG. 5 is a schematic diagram illustrating an exemplary embodiment of the display panel of FIG. 1.

FIG. 5 is a schematic diagram illustrating an exemplary embodiment of the display panel of FIG. 1.

Referring to FIGS. 1, 2A, 2B and 5, a plurality of pixels P1, P2, . . . , P12 are in the display area DA of the display panel 100, and the pixels P1, P2, . . . , P12 are electrically connected to a plurality of data lines DLm−1, DLm, DLm+1 and DLm+2 and a plurality of gate lines GLi−1, GLj−1, GLi and GLj. The first gate driving circuit 210 is in the first peripheral area PA1 of the display panel 100, and provides the gate signals to the gate lines GLi−1 and GLi. The second gate driving circuit 230 is in the second peripheral area PA2 of the display panel 100, and provides the gate signals to the gate lines GLj−1 and GLj.

In one exemplary embodiment, for example, first pixel P1 and second pixel P2 of a first pixel row PL1, and seventh pixel P7 and eighth pixel P8 of a second pixel row PL2, are between the (m−1)-th and m-th data lines DLm−1 and DLm. Third pixel P3 and fourth pixel P4 of the first pixel row PL1 and ninth pixel P9 and tenth pixel P10 of the second pixel row PL2, are between the m-th and the (m+1)-th data lines DLm and DLm+1. Fifth pixel P5 and sixth pixel P6 of the first pixel row PL1 and eleventh pixel P11 and twelfth pixel P12 of the second pixel row PL2, are between the (m+1)-th and the (m+2)-th data lines DLm+1 and DLm+2. The first to sixth pixels P1, P2, . . . , P6 are sequentially arranged in the first pixel row PL1 and the seventh to twelfth pixels P7, P8, . . . , P12 are sequentially arranged in second pixel row PL2.

Each of the seventh to twelfth pixels P7, P8, . . . , P12 is arranged in a column direction with respect to each of the first to sixth pixels P1, P2, . . . , P6, respectively. As shown in FIG. 5, pixels of a pixel column are electrically connected to an upper gate line at the first side of the pixel row or a lower gate line at the second side of the same pixel row. In one exemplary embodiment, for example, each the first and seventh pixels P1 and P7 of a first pixel column PC1 is electrically connected to the upper gate line, and each of the second and eighth pixels P2 and P8 of a second pixel column PC2 is electrically connected to the lower gate line.

An (i−1)-th gate line GLi−1 is at the first side (upper side) of the first pixel row PL1 and a (j−1)-th gate line GLj−1 is at the second side (lower side) of the first pixel row PL1. The (i−1)-th and (j−1)-th gate lines GLi−1 and GLj−1 are electrically connected to the first to sixth pixels P1, P2, . . . , P6 of the first pixel row PL1. An i-th gate line GLi is at the first side (upper side) of the second pixel row PL2 and a j-th gate line GLj is at the second side (lower side) of the second pixel row PL2. The i-th and j-th gate lines GLi and GLj are electrically connected to the seventh to twelfth pixels P7, P8, . . . , P12 of the second pixel row PL2.

Referring to the pixels P1, P2, . . . , P6 of the first pixel row PL1, all of the first and second pixels P1 and P2 are connected to the m-th data line DLm of the adjacent (m−1)-th and m-th data lines DLm−1 and DLm, all of the third and fourth pixels P3 and P4 are connected to the (m+1)-th data line DLm+1 of the adjacent m-th and (m+1)-th data lines DLm and DLm+1, and all of the fifth and sixth pixels P5 and P6 are connected to the (m+2)-th data line DLm+2 of the adjacent (m+1)-th and (m+2)-th data lines DLm+1 and DLm+2.

The first, third and sixth pixels P1, P3 and P6 are connected to the (i−1)-th gate line GLi−1 at the upper side, and the second, fourth and fifth pixels P2, P4 and P5 are connected to the (j−1)-th gate line GLj−1 at the lower side. Therefore, the pixels P1, P2, . . . , P6 of the first pixel row PL1 may be driven by the (i−1)-th stage SCi−1 of the first gate driving circuit 210 and the (j−1)-th stage SCj−1 of the second gate driving circuit 230.

Referring to the pixels P7, P8, . . . , P12 of the second pixel row PL2, all of the seventh and eighth pixels P7 and P8 are connected to the (m−1)-th data line DLm−1 of the adjacent (m−1)-th and m-th data lines DLm−1 and DLm, all of the ninth and tenth pixels P9 and P10 are connected to the m-th data line DLm of the adjacent m-th and (m+1)-th data lines DLm and DLm+1, and all of the eleventh and twelfth pixels P11 and P12 are connected to the (m+1)-th data line DLm+1 of the adjacent (m+1)-th and (m+2)-th data lines DLm+1 and DLm+2.

The seventh, ninth and twelfth pixels P7, P9 and P12 are connected to the i-th gate line GLi at the upper side, and the eighth, tenth and eleventh pixels P8, P10 and P11 are connected to the j-th gate line GLj at the lower side. Therefore, the pixels P7, P8, . . . , P12 of the second pixel row PL2 may be driven by the i-th stage SCi of the first gate driving circuit 210 and the j-th stage SCj of the second gate driving circuit 230.

In one exemplary embodiment, for example, when the display panel 100 includes red, green and blue pixels, the first and fourth pixels P1 and P4 may be the blue pixel, the second and fifth pixels P2 and P5 may be the red pixel, and third and sixth pixels P3 and P6 may be the green pixel, in the first pixel row PL1. In addition, the seventh and tenth pixels P7 and P10 are the blue pixel, the eighth and eleventh pixels P8 and P11 are the red pixel, and the ninth and twelfth pixels P9 and P12 are the green pixel, in the second pixel row PL2.

Therefore, the second, fifth, eighth and eleventh pixels P2, P5, P8 and P11 that are the red pixel, are electrically connected to the (j−1)-th and j-th gate lines GLj−1 and GLj so as to be driven by the second gate driving circuit 230. The third, sixth, ninth and twelfth pixels P3, P6, P9 and P12 that are green pixel, are electrically connected to the (i−1)-th and i-th gate lines GLi−1 and GLi so as to be driven by the first gate driving circuit 210. The first, fourth, seventh and tenth pixels P1, P4, P7 and P10 that are blue pixel, are electrically connected to the (i−1)-th, (j−1)-th, i-th and j-th gate lines GLi−1, GLj−1, GLi and GLj so as to be driven by the first and second gate driving circuits 210 and 230.

Figure 6A:
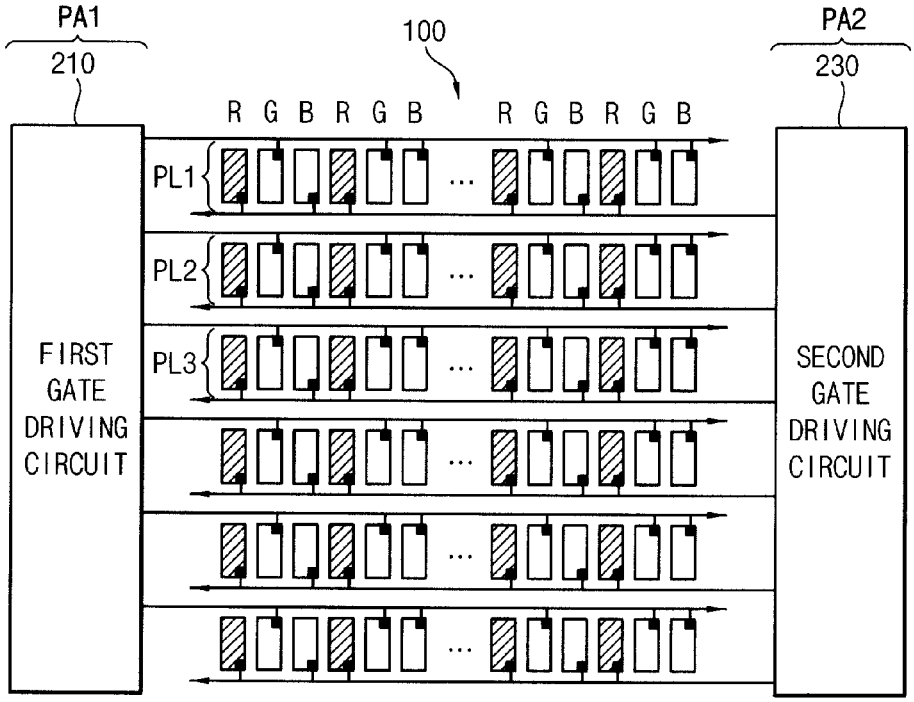
FIGS. 6A to 6C are schematic diagrams illustrating exemplary embodiments of an image quality according to driving each of color pixels included in the display panel of FIG. 1.
Figure 6B:
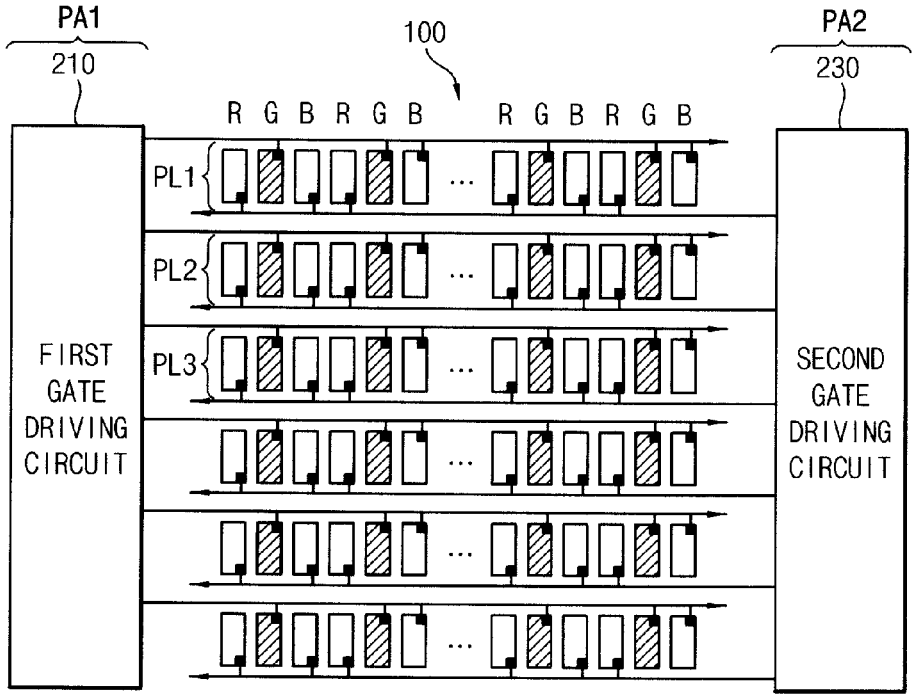
Figure 6C:
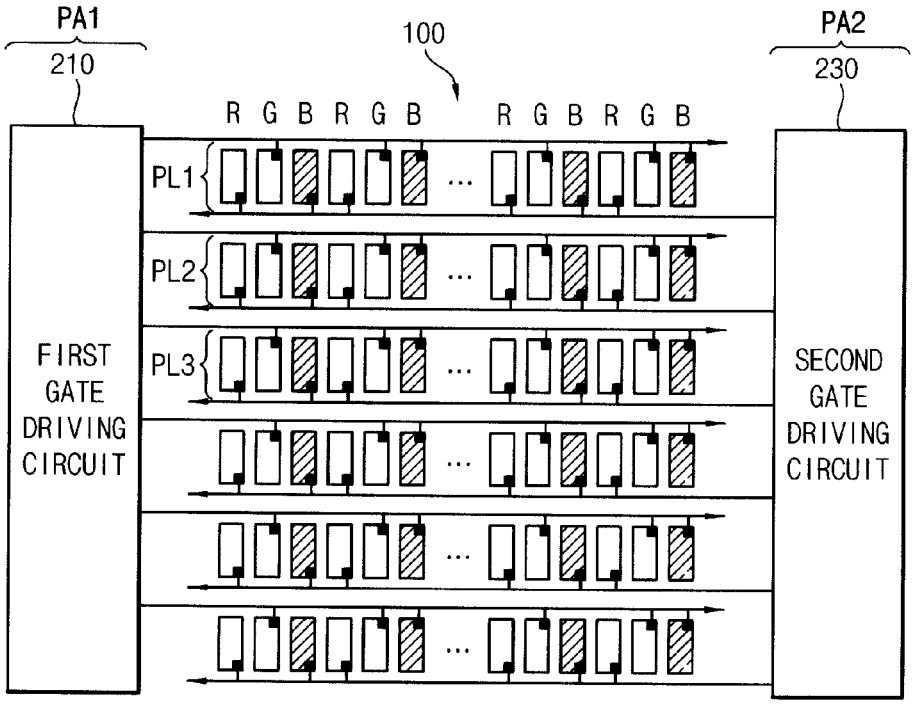

FIGS. 6A to 6C are schematic diagrams illustrating exemplary embodiments of an image quality according to driving each of color pixels included in the display panel of FIG. 1.

Referring to FIGS. 5 and 6A, the display panel 100 shown in FIG. 6A exemplifies that a plurality of red pixels R are driven. The red pixels R of the first pixel row PL1 are connected to the gate line at the lower side of the first pixel row PL1, and the red pixels R of the second pixel row PL2 are connected to the gate line at the lower side of the second pixel row PL2. Thus, the red pixels R are connected to the gate line at the lower side with respect to the pixel row. The red pixels R of the display panel 100 are driven by the second gate driving circuit 230 that provides the gate signal to the gate line at the lower side.

Therefore, the gate signal generated from the second gate driving circuit 230 is transmitted toward the first gate driving circuit 210 that is opposite to second gate driving circuit 230. By a resistance of the gate line, a delay difference between the gate signals applied to the red pixel R adjacent to the second gate driving circuit 230 and the red pixel R adjacent to the first gate driving circuit 210 may occur so that the red pixels R may have a charge difference gradually changed according to the delay difference. However, the charge difference uniformly occurs in all pixel rows PL1, PL2, PL3, . . . so that a red significant difference does not occur according to the charge difference in the display panel 100.

Referring to FIGS. 5 and 6B, the display panel 100 shown in FIG. 6B exemplifies that a plurality of green pixels G are driven. The green pixels G of the first pixel row PL1 are connected to the gate line at the upper side of the first pixel row PL1, and the green pixels G of the second pixel row PL2 are connected to the gate line at the upper side of the second pixel row PL2. Thus, the green pixels G are connected to the gate line at the upper side with respect to the pixel row. The green pixels G of the display panel 100 are driven by the first gate driving circuit 210 that provides the gate signal to the gate line at the upper side.

Therefore, the gate signal generated from the first gate driving circuit 210 is transmitted toward the second gate driving circuit 230 that is opposite to the first gate driving circuit 210. By a resistance of the gate line, a delay difference between the gate signals applied to the green pixel G adjacent to the first gate driving circuit 210 and the green pixel G adjacent to the second gate driving circuit 230 may occur so that the green pixels G may have a charge difference gradually changed according to the delay difference. However, the charge difference uniformly occurs in all pixel rows PL1, PL2, PL3, . . . so that a green significant difference does not occur according to the charge difference in the display panel 100.

Referring to FIGS. 5 and 6C, the display panel 100 shown in FIG. 6B exemplifies that a plurality of blue pixels B are driven. The blue pixels B of the first pixel row PL1 are connected to gate lines at both the upper and lower sides of the first pixel row PL1, and the blue pixels B of the second pixel row PL2 are connected to gate lines at both the upper and lower sides of the second pixel row PL2. Thus, the blue pixels B are collectively connected to all gate lines respectively at the upper and lower sides with respect to the pixel row. The blue pixels B of the display panel 100 are driven by the first and second gate driving circuits 210 and 230 that provide the gate signals to all gate lines at the upper and lower sides, respectively.

Therefore, by a resistance of the gate line, the charge difference between the blue pixel B adjacent to the first gate driving circuit 210 and the blue pixel B adjacent to the second gate driving circuit 230 may occur so that a defect such as a vertical line may occur according to the charge difference. However, the blue is hardly recognized compared to the red or the green so that a display quality is not decreased.

According to a pixel structure of the illustrated exemplary embodiment, one of the first and second gate driving circuits 210 and 230 provides the gate signal to the upper gate line of the pixel row, and the other provides the gate signal to the lower gate line of the pixel row. Thus, a significant difference of the display quality according to a delay difference of the gate signals does not occur.

Figure 7A:
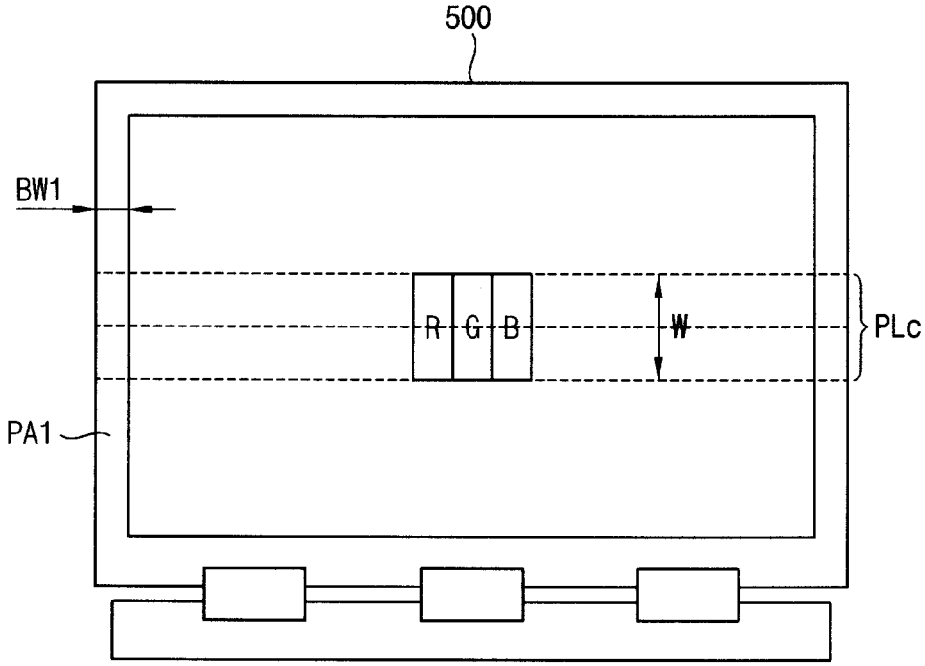
FIGS. 7A to 7B are schematic diagrams illustrating exemplary embodiments of an appearance quality improvement according to the display apparatus of FIG. 1.
Figure 7B:
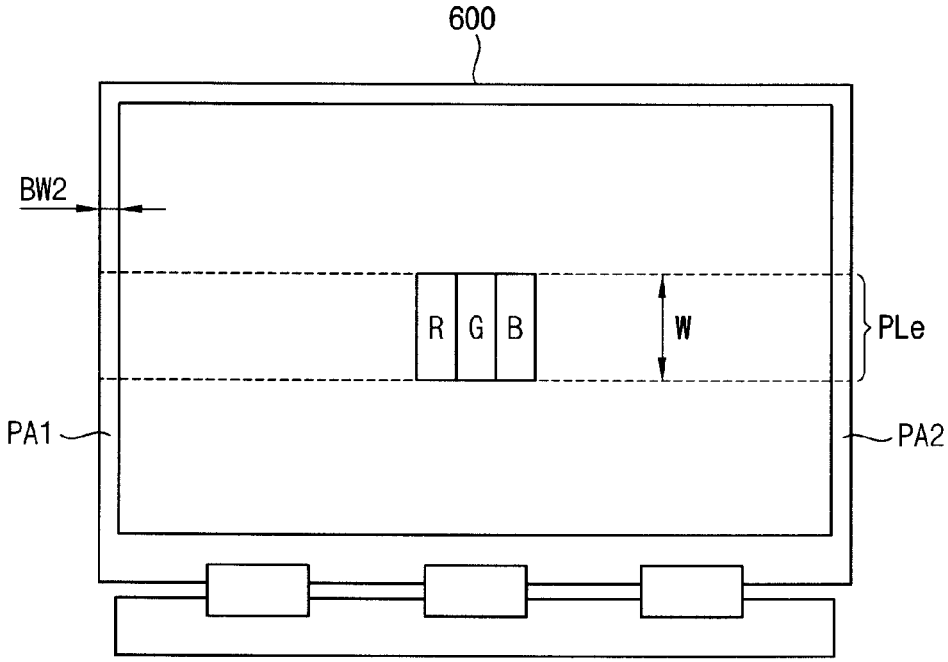

FIGS. 7A to 7B are schematic diagrams illustrating exemplary embodiments of an appearance quality improvement according to the display apparatus of FIG. 1.

Referring to FIGS. 1 and 7A, two circuit stages are in a first peripheral area PA1 of a display panel 500, and the two circuit stages provide two gate signal to two gate lines at upper and lower sides of the a pixel row PLc, respectively.

In this case, the two circuit stages are in an area of the first peripheral area PA1 corresponding to a width W of the pixel row PLc. That is, a total width occupied by the two circuit stages is no more than the width W of the pixel row PLc, such that the two circuit stages are completely within the width W of the pixel row PLc. Thus, two circuit stages are in the area having the width W so that a width BW1 of a bezel corresponding to the peripheral area of the display panel 500 may be increased.

Referring to FIGS. 1 and 7B, two circuit stages are in the first and second peripheral areas PA1 and PA2 of a display panel 600, and provide two gate signal to two gate lines at upper and lower sides of the a pixel row Ple, respectively, according to the illustrated exemplary embodiment. The significant difference of the display quality according to the delay difference of two gate signals does not occur as described in FIGS. 6A to 6C. A first of the two circuit stages may be in the first peripheral area PA1 and a second of the two circuit stages may be in the second peripheral area PA2.

In this case, the first circuit stage may be in an area of the first peripheral area PA1 corresponding to a width W of the pixel row PLe, and the second circuit stage may be in an area of the second peripheral area PA2 corresponding to a width W of the pixel row PLe. A width BW2 of a bezel corresponding to the peripheral area of the display panel 600 may be smaller than the width BW1 described in FIG. 7A by at least about 50%.

Thus, in the display panel 600 having the pixel structure of the illustrated exemplary embodiment, the bezel width may be decreased so that the appearance quality of the display apparatus may be improved.

Hereinafter, the same reference numerals will be used to refer to the same or like parts as those described in the previous exemplary embodiment, and any repetitive detailed explanation will be omitted.

Figure 8:
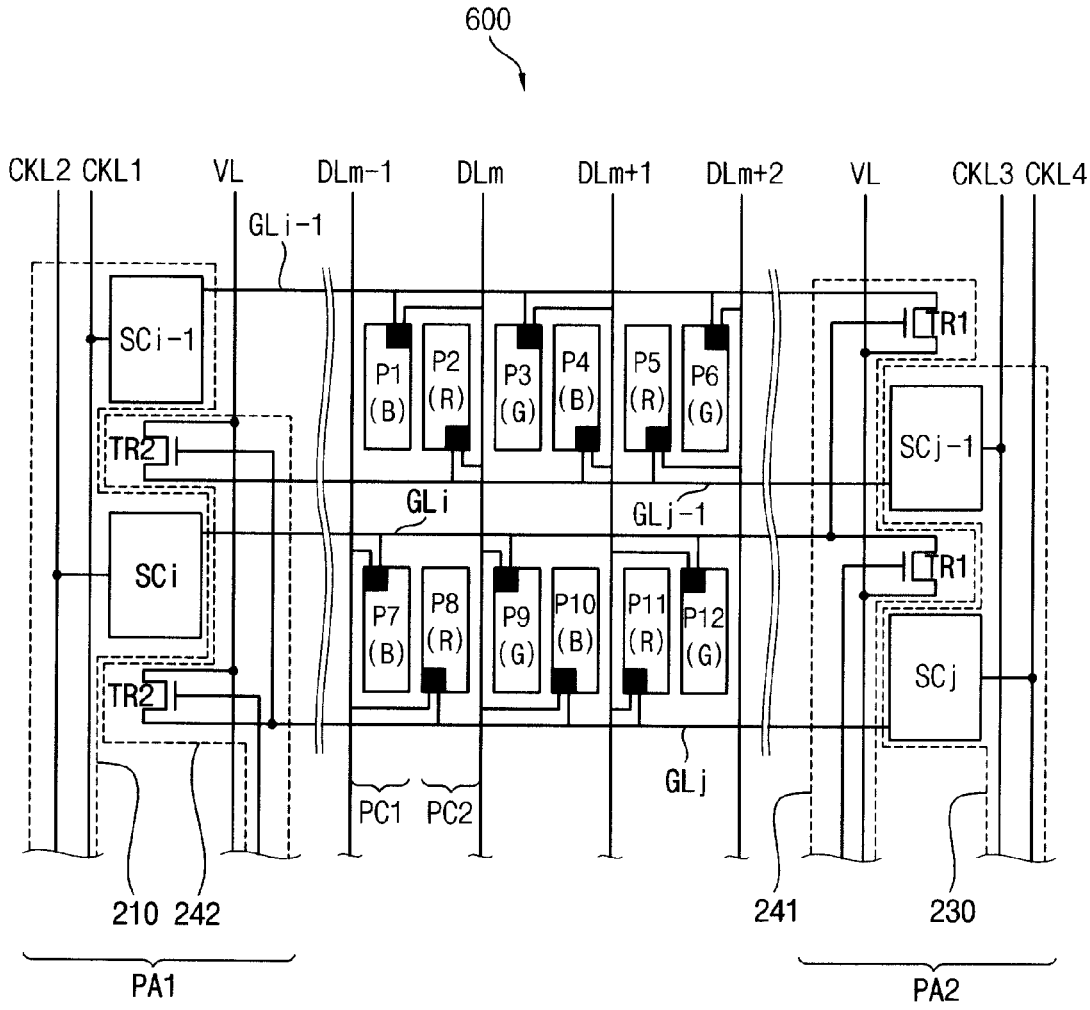
FIG. 8 is a schematic diagram illustrating another exemplary embodiment of a display panel according to still the invention.

FIG. 8 is a schematic diagram illustrating another exemplary embodiment of a display panel according to the invention.

Referring to FIGS. 1, 3 and 8, the display panel 600 includes the first gate driving circuit 210, a first discharging circuit 241, the second gate driving circuit 230 and a second discharging circuit 242.

The first gate driving circuit 210 includes stages SCi−1 and SCi in a first peripheral area PA1, and each of the stages SCi−1 and SCi provides gate signals to gate lines GLi−1 and GLi at a first side of each pixel row. The first gate driving circuit 210 is electrically connected to a first end of the gate lines GLi−1 and GLi.

The first discharging circuit 241 is in a second peripheral area PA2. The first discharging circuit 241 is electrically connected to a second end of the gate lines GLi−1 and Gli opposite to the first end, and discharges a high voltage VON of the gate signal applied to each gate line GLi−1 or GLi to a low voltage VOFF. The first discharging circuit 241 includes a first discharging transistor TR1 and a voltage line VL transmitting the low voltage VOFF. As shown in FIG. 8, the first discharging transistor TR1 is in the second peripheral area PA2 between the stages SCj−1 and SCj−2 and is in the second peripheral area PA2 corresponding to (e.g., not exceeding) a width of the pixel row defined by a distance between the (i−1)-th and (j−1)-th gate lines GLi−1 and GLj−1.

The first discharging transistor TR1 includes a first control electrode, a first input electrode and a first output electrode. In one exemplary embodiment, for example, the first control electrode is connected to the i-th gate line GLi connected to the i-th stage SCi, the first input electrode is connected to the (i−1)-th gate line GLi−1, and the first output electrode is connected to the voltage line VL. When the high voltage VON is applied to the i-th gate line GLi, the first discharging transistor TR1 is turned on. The first discharging transistor TR1 discharges the high voltage VON applied to the (i−1)-th gate line GLi−1 to the low voltage VOFF.

The second gate driving circuit 230 includes the stages SCj−1 and SCj in the second peripheral area PA2, and each of the stages SCj−1 and SCj provides the gate signals to the gate lines GLj−1 and GLj at the second side of each pixel row. The second gate driving circuit 230 is electrically connected to the second end of the gate lines GLj−1 and GLj.

The second discharging circuit 242 is in the first peripheral area PA1. The second discharging circuit 242 is electrically connected to the first end of the gate lines GLj−1 and GLj, and discharges the high voltage VON of the gate signal applied to each gate lines GLj−1 or GLj to the low voltage VOFF. The second discharging circuit 242 includes a second discharging transistor TR2 and a voltage line VL transmitting the low voltage VOFF. As shown in FIG. 8, the second discharging transistor TR2 is in the first peripheral area PA1 between the stages SCi−1 and SCi, and is in the first peripheral area PA1 corresponding to (e.g., not exceeding) the width of the pixel row defined by a distance between the (i−1)-th and (j−1)-th gate lines GLi−1 and GLj−1.

The second discharging transistor TR2 includes a second control electrode, a second input electrode and a second output electrode. In one exemplary embodiment, for example, the second control electrode is connected to the j-th gate line GLj connected to the j-th stage SCj, the second input electrode is connected to the (j−1)-th gate line GLj−1, and the second output electrode is connected to the voltage line VL. When the high voltage VON is applied to the j-th gate line GLj, the second discharging transistor TR2 is turned on. The second discharging transistor TR2 discharges the high voltage VON applied to the (j−1)-th gate line GLj−1 to the low voltage VOFF.

Figure 9:
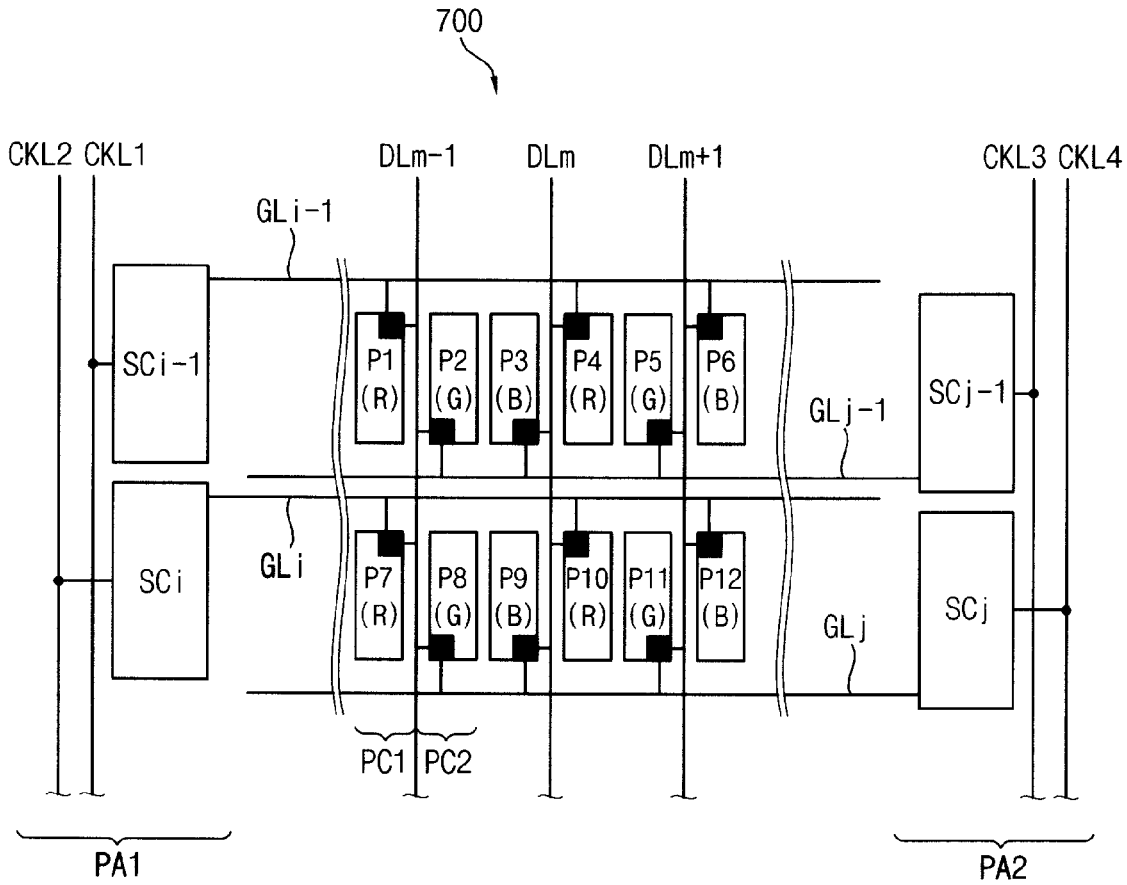
FIG. 9 is a schematic diagram illustrating still another exemplary embodiment of a display panel according to the invention.

FIG. 9 is a schematic diagram illustrating still another exemplary embodiment of a display panel according to the invention.

Referring to FIGS. 1, 2A, 2B and 9, the display panel 700 includes the plurality of data lines DLm−1, DLm and DLm+1, the plurality of gate lines GLi−1, GLj−1, GLi and GLj, and the plurality of pixels P1, P2, . . . , P12 electrically connected to the data lines DLm−1, DLm and DLm+1 and the gate lines GLi−1, GLj−1, GLi and GLj in the display area DA. The display panel 700 includes the first gate driving circuit 210 providing gate signals to the gate lines GLi−1 and GLi in the first peripheral area PA1 and the second gate driving circuit 230 providing to gate signals to the gate lines GLj−1 and GLj in the second peripheral area PA2.

In one exemplary embodiment, for example, the (m−1)-th data line DLm−1 is between the first pixel P1 and the second pixel P2 of the first pixel row PL1, and between the seventh pixel P7 and the eighth pixel P8 of the second pixel row PL2. The m-th data line DLm is between the third pixel P3 and the fourth pixel P4 of the first pixel row PL1, and between the ninth pixel P9 and the tenth pixel P10 of the second pixel row PL2. The (m+1)-th data line DLm+1 is between the fifth pixel P5 and the sixth pixel P6 of the first pixel row PL1, and between the eleventh pixel P11 and the twelfth pixel P12 of the second pixel row PL2. The first to sixth pixels P1, P2, . . . , P6 are sequentially arranged in the first pixel row PL1 and the seventh to twelfth pixels P7, P8, . . . , P12 are sequentially arranged in the second pixel row PL2 as shown in FIG. 9.

Each of the seventh to twelfth pixels P7, P8, . . . , P12 is arranged in a column direction with respect to each of the first to sixth pixels P1, P2, . . . , P6. As shown in FIG. 9, pixels of a pixel column are electrically connected to an upper gate line at the first side of the pixel row or a lower gate line at the second side of the pixel row. In one exemplary embodiment, for example, each the first and seventh pixels P1 and P7 of the first pixel column PC1 is electrically connected to the upper gate line, and each of the second and eighth pixels P2 and P8 of the second pixel column PC2 is electrically connected to the lower gate line.

An (i−1)-th gate line GLi−1 is at a first side (upper side) of the first pixel row PL1 and a (j−1)-th gate line GLj−1 is at a second side (lower side) of the first pixel row PL1. The (i−1)-th and (j−1)-th gate lines GLi−1 and GLj−1 are electrically connected to the first to sixth pixels P1, P2, . . . , P6 of the first pixel row PL1. An i-th gate line GLi is at the first side (upper side) of the second pixel row PL2 and a j-th gate line GLj is at the second side (lower side) of the second pixel row PL2. The i-th and j-th gate lines GLi and GLj are electrically connected to the seventh to twelfth pixels P7, P8, . . . , P12 of the second pixel row PL2.

Referring to the pixels P1, P2, . . . , P6 of the first pixel row PL1, all of the first and second pixels P1 and P2 are connected to the (m−1)-th data line DLm−1, all of the third and fourth pixels P3 and P4 are connected to the m-th data line DLm, and all of the fifth and sixth pixels P5 and P6 are connected to the (m+1)-th data line DLm+1.

The first, fourth and sixth pixels P1, P4 and P6 are connected to the (i−1)-th gate line GLi−1, and the second, third and fifth pixels P2, P3 and P5 are connected to the (j−1)-th gate line GLj−1. Therefore, the pixels P1, P2, . . . , P6 of the first pixel row PL1 may be driven by the (i−1)-th stage SCi−1 of the first gate driving circuit 210 and the (j−1)-th stage SCj−1 of the second gate driving circuit 230.

Referring to the pixels P7, P8, . . . , P12 of the second pixel row PL2, all of the seventh and eighth pixels P7 and P8 are connected to the (m−1)-th data line DLm−1, all of the ninth and tenth pixels P9 and P10 are connected to the m-th data line DLm, and all of the eleventh and twelfth pixels P11 and P12 are connected to the (m+1)-th data line DLm+1.

The seventh, tenth and twelfth pixels P7, P10 and P12 are connected to the i-th gate line GLi, and the eighth, ninth and eleventh pixels P8, P9 and P11 are connected to the j-th gate line GLj. Therefore, the pixels P7, P8, . . . , P12 of the second pixel row PL2 may be driven by the i-th stage SCi of the first gate driving circuit 210 and the j-th stage SCj of the second gate driving circuit 230.

In one exemplary embodiment, for example, when the display panel 700 includes red, green and blue pixels, the first and fourth pixels P1 and P4 may be the red pixel, the second and fifth pixels P2 and P5 may be the green pixel, and third and sixth pixels P3 and P6 may be the blue pixel in the first pixel row PL1. In addition, the seventh and tenth pixels P7 and P10 are the red pixel, the eighth and eleventh pixels P8 and P11 are the green pixel, and the ninth and twelfth pixels P9 and P12 are the blue pixel in the second pixel row PL2.

Therefore, the first, fourth, seventh and tenth pixels P1, P4, P7 and P10 that are the red pixel, are electrically connected to the (i−1)-th and i-th gate lines GLi−1 and GLi so as to be driven by the first gate driving circuit 210. The second, fifth, eighth and eleventh pixels P2, P5, P8 and P11 that are green pixel, are electrically connected to the (j−1)-th and j-th gate lines GLj−1 and GLj so as to be driven by the second gate driving circuit 230. The third, sixth, ninth and twelfth pixels P3, P6, P9 and P12 that are blue pixel, are electrically connected to the (i−1)-th, (j−1)-th, i-th and j-th gate lines GLi−1, GLj−1, GLi and GLj so as to be driven by both of the first and second gate driving circuits 210 and 230.

Figure 10A:
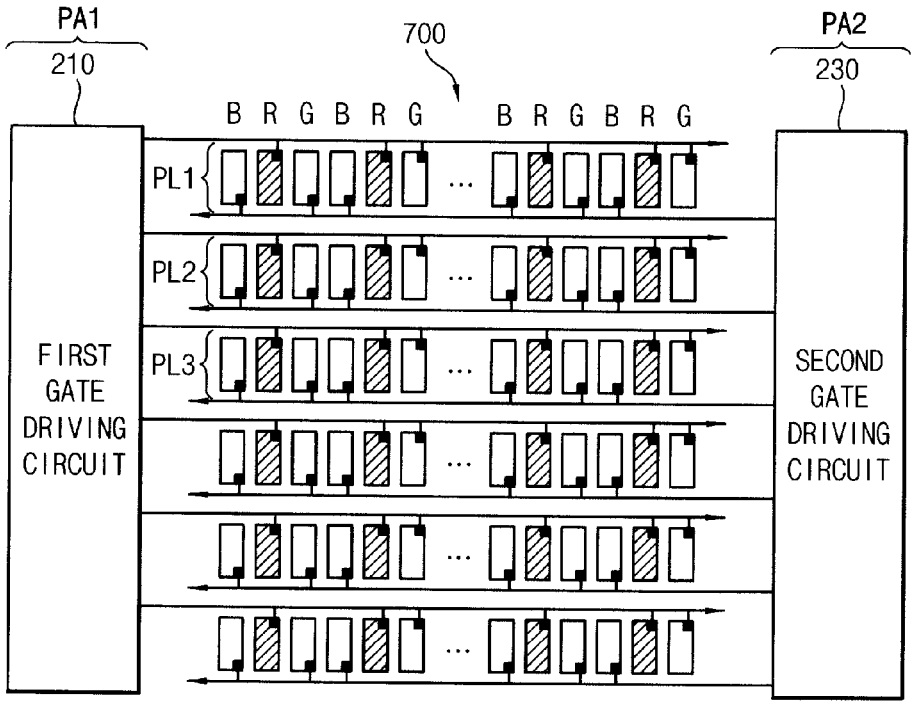
FIGS. 10A to 10C are schematic diagrams illustrating exemplary embodiments of an image quality according to driving each of color pixels included in the display panel of FIG. 9.
Figure 10B:
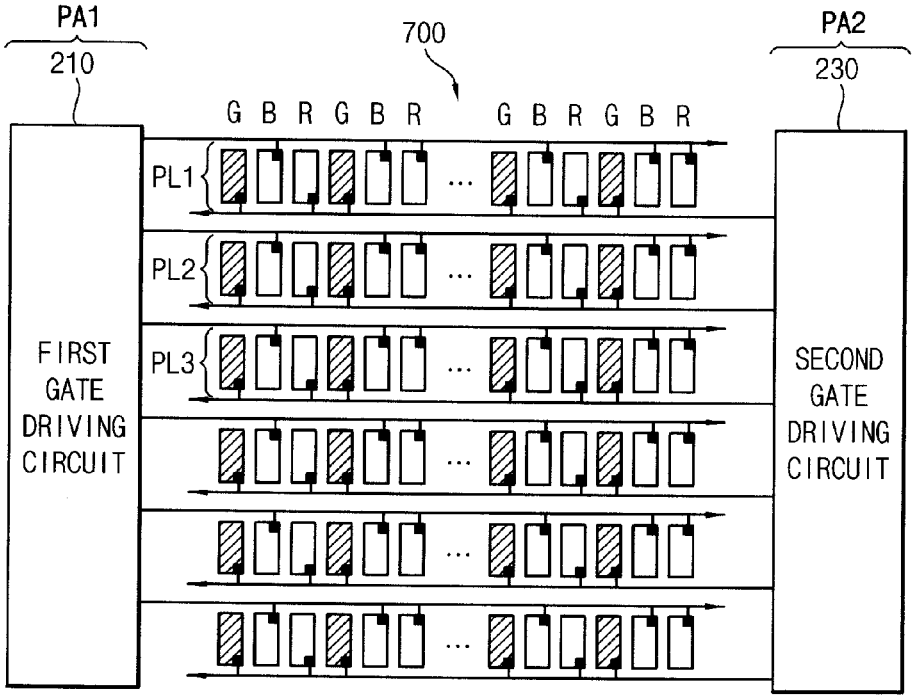
Figure 10C:
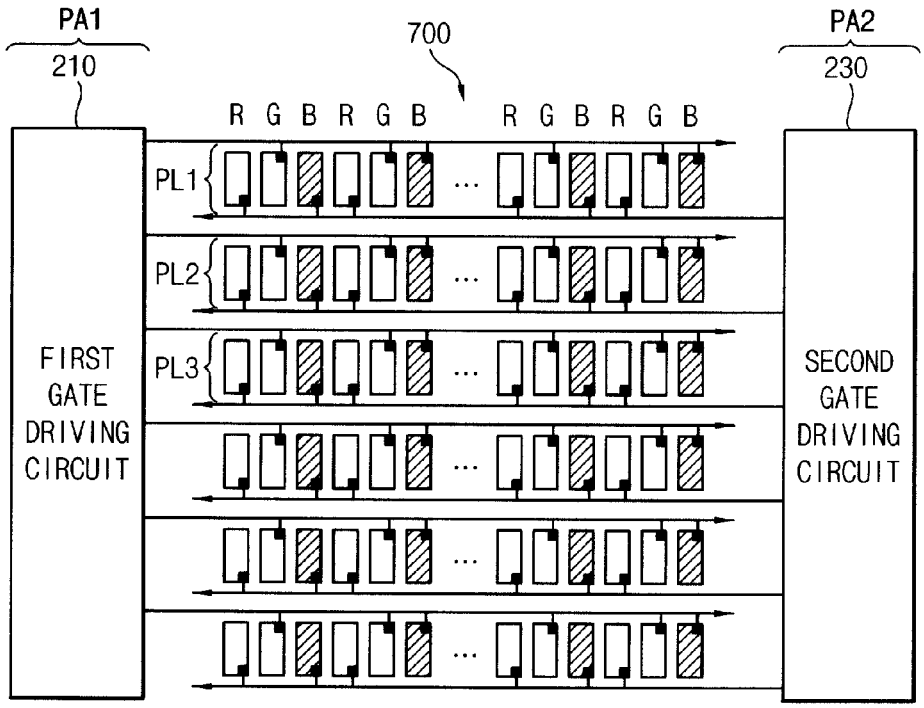

FIGS. 10A to 10C are schematic diagrams illustrating exemplary embodiments of an image quality according to driving each of color pixels included in the display panel of FIG. 9.

Referring to FIGS. 9 and 10A, the display panel 700 shown in FIG. 10A exemplifies that a plurality of red pixels R are driven. The red pixels R of the first pixel row PL1 are connected to the gate line at the upper side of the first pixel row PL1, and the red pixels R of the second pixel row PL2 are connected to the gate line at the upper side of the second pixel row PL2. Thus, the red pixels R are connected to the gate line at the upper side with respect to the pixel row. The red pixels R of the display panel 700 are driven by the first gate driving circuit 210 that provides the gate signal to the gate line at the upper side.

Therefore, the gate signal generated from the first gate driving circuit 210 is transmitted toward the second gate driving circuit 230 that is opposite to first gate driving circuit 210. By a resistance of the gate line, a delay difference between the gate signals applied to the red pixel R adjacent to the first gate driving circuit 210 and the red pixel R adjacent to the second gate driving circuit 230 may occur so that the red pixels R may have a charge difference gradually changed according to the delay difference. However, the charge difference uniformly occurs in all pixel rows PL1, PL2, PL3, . . . so that a red significant difference does not occur according to the charge difference in the display panel 700.

Referring to FIGS. 9 and 10B, the display panel 700 shown in FIG. 10B exemplifies that a plurality of green pixels G are driven. The green pixels G of the first pixel row PL1 are connected to the gate line at the lower side of the first pixel row PL1, and the green pixels G of the second pixel row PL2 are connected to the gate line at the lower side of the second pixel row PL2. Thus, the green pixels G are connected to the gate line at the lower side of the upper and lower sides with respect to the pixel row. The green pixels G of the display panel 700 are driven by the second gate driving circuit 230 that provides the gate signal to the gate line at the lower side.

Therefore, the gate signal generated from the second gate driving circuit 230 is transmitted toward the first gate driving circuit 210 that is opposite to the second gate driving circuit 230. By a resistance of the gate line, a delay difference between the gate signals applied to the green pixel G adjacent to the second gate driving circuit 230 and the green pixel G adjacent to the first gate driving circuit 210 may occur so that the green pixels G may have a charge difference gradually changed according to the delay difference. However, the charge difference uniformly occurs in all pixel rows PL1, PL2, PL3, . . . so that a green significant difference does not occur according to the charge difference in the display panel 700.

Referring to FIGS. 9 and 10C, the display panel 700 shown in FIG. 10C exemplifies that a plurality of blue pixels B are driven. The blue pixels B of the first pixel row PL1 are connected to gate lines at both the upper and lower sides of the first pixel row PL1, and the blue pixels B of the second pixel row PL2 are connected to gate lines at both the upper and lower sides of the second pixel row PL2. Thus, the blue pixels B are collectively connected to all gate lines respectively at the upper and lower sides with respect to the pixel row. The blue pixels B of the display panel 100 are driven by the first and second gate driving circuits 210 and 230 that provide the gate signals to all gate lines at the upper and lower sides, respectively.

Therefore, by a resistance of the gate line, the charge difference between the blue pixel B adjacent to the first gate driving circuit 210 and the blue pixel B adjacent to the second gate driving circuit 230 may occur so that a defect such as a vertical line may occur according to the charge difference. However, the blue is hardly recognized compared to the red or the green so that a display quality is not decreased.

According to a pixel structure of the illustrated exemplary embodiment, one of the first and second gate driving circuits 210 and 230 provides the gate signal to the upper gate line of the pixel row, and the other provides the gate signal to the lower gate line of the pixel row. Thus, a significant difference of the display quality according to a delay difference of the gate signals does not occur.

Figure 11:
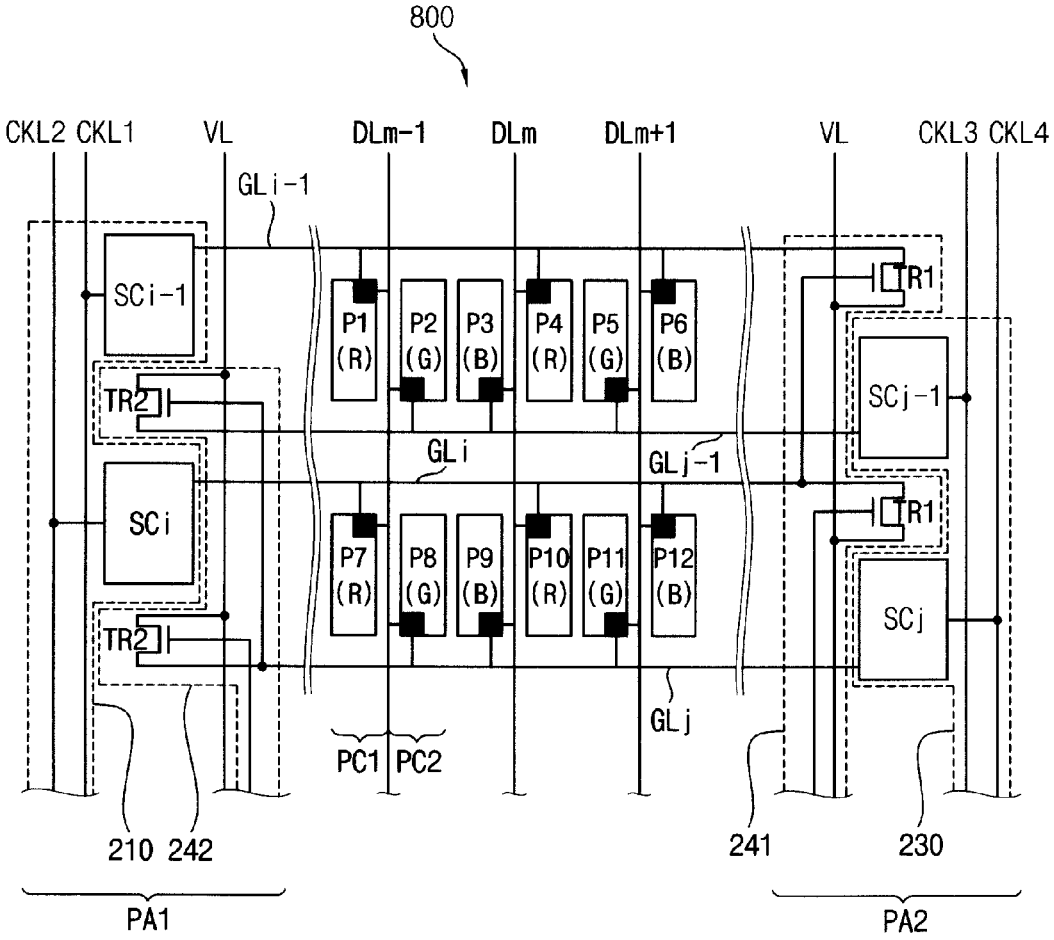
FIG. 11 is a schematic diagram illustrating still another exemplary embodiment of a display panel according to the invention.

FIG. 11 is a schematic diagram illustrating still another exemplary embodiment of a display panel according to the invention. The display panel 800 according to the illustrated exemplary embodiment further includes the first and second discharging circuits 241 and 242 as described in FIG. 8 in the display panel 700 as described in FIG. 9. Hereinafter, the same reference numerals will be used to refer to the same or like parts as those described in the previous exemplary embodiment, and any repetitive detailed explanation will be simplified.

Referring to FIGS. 9 and 11, the display panel 800 includes the first gate driving circuit 210, the first discharging circuit 241, the second gate driving circuit 230 and the second discharging circuit 242.

The first gate driving circuit 210 includes stages SCi−1 and SCi in a first peripheral area PA1, and each of the stages SCi−1 and SCi provides gate signals to the gate lines GLi−1 and GLi at a first side of each pixel row.

The first discharging circuit 241 is in a second peripheral area PA2. The first discharging circuit 241 includes the first discharging transistor TR1 and the voltage line VL transmitting the low voltage VOFF. As shown in FIG. 11, the first discharging transistor TR1 is in the second peripheral area PA2 between the stages SCj−1 and SCj−2 and is in the second peripheral area PA2 corresponding to a width of the pixel row defined by the distance between the (i−1)-th and (j−1)-th gate lines GLi−1 and GLj−1.

The first discharging transistor TR1 includes a first control electrode, a first input electrode and a first output electrode. In one exemplary embodiment, for example, the first control electrode is connected to the i-th gate line GLi connected to the i-th stage SCi, the first input electrode is connected to the (i−1)-th gate line GLi−1, and the first output electrode is connected to the voltage line VL.

The second gate driving circuit 230 includes stages SCj−1 and SCj in the second peripheral area PA2, and each of the stages SCj−1 and SCj provides gate signals to the gate lines GLj−1 and GLj at the second side of each pixel row.

The second discharging circuit 242 is in the first peripheral area PA1. The second discharging circuit 242 includes the second discharging transistor TR2 and the voltage line VL transmitting the low voltage VOFF. As shown in FIG. 11, the second discharging transistor TR2 is in the first peripheral area PA1 between the stages SCi−1 and SCi and is in the first peripheral area PA1 corresponding to a width of the pixel row defined by the distance between the (i−1)-th and (j−1)-th gate lines GLi−1 and GLj−1.

The second discharging transistor TR2 includes a second control electrode, a second input electrode and a second output electrode. In one exemplary embodiment, for example, the second control electrode is connected to the j-th gate line GLj connected to the j-th stage SCj, the second input electrode is connected to the (j−1)-th gate line GLj−1, and the second output electrode is connected to the voltage line VL.

According to the above-mentioned exemplary embodiments, one of the first and second gate driving circuits 210 and 230 provides the gate signal to the gate line at the first side of the pixel row, and the other provides the gate signal to the gate line at the second side of the pixel row opposite to the first side, so that the bezel width may be decreased and an electric power consumption may be decreased in a high resolution display apparatus. In addition, by the pixel structure of the above-mentioned exemplary embodiments, the significant difference according to the delay difference of the gate signals may be reduced or effectively prevented.

The foregoing is illustrative of the invention and is not to be construed as limiting thereof. Although a few exemplary embodiments of the invention have been described, those skilled in the art will readily appreciate that many modifications are possible in the exemplary embodiments without materially departing from the novel teachings and advantages of the invention. Accordingly, all such modifications are intended to be included within the scope of the invention as defined in the claims. In the claims, means-plus-function clauses are intended to cover the structures described herein as performing the recited function and not only structural equivalents but also equivalent structures. Therefore, it is to be understood that the foregoing is illustrative of the invention and is not to be construed as limited to the specific exemplary embodiments disclosed, and that modifications to the disclosed exemplary embodiments, as well as other exemplary embodiments, are intended to be included within the scope of the appended claims. The invention is defined by the following claims, with equivalents of the claims to be included therein.

What is claimed is:

1. A display panel comprising:

a display area;

a plurality of pixels which is disposed in the display area, and comprises a first pixel row and a second pixel row;

a plurality of data lines which extends in a column direction, and comprises an (m−1)-th data line, an m-th data line, an (m+1)-th data line and an (m+2)-th data line which are sequential, where m is a natural number; and a plurality of gate lines which extends in a row direction, and comprises a first gate line;

and a second gate line which are sequential, wherein the first pixel row is disposed between the first gate line and the second gate line, first and second pixels included in a first pixel row between the (m−1)-th data line and the m-th data line are electrically connected to the m-th data line, third and fourth pixels included in the first pixel row between the m-th data line and the (m+1)-th data line are electrically connected to the (m+1)-th data line, fifth and sixth pixels included in the first pixel row between the (m+1)-th data line and the (m+2)-th data line are electrically connected to the (m+2)-th data line, first, third and sixth pixels of the first pixel row are electrically connected to the first gate line at a first side of the first pixel row, and second, fourth and fifth pixels of the first pixel row are electrically connected to the second gate line at a second side of the first pixel row.

2. The display panel of claim 1, further comprising:

a peripheral area which surrounds the display area and includes a first peripheral area, and a second peripheral area opposite to the first peripheral area;

a first gate driving circuit which is disposed in the first peripheral area and includes a first stage which provides a gate signal to the first gate line;

a second gate driving circuit which is disposed in the second peripheral area and includes a second stage which provides the gate signal to the second gate line;

a first clock line which transmits a first clock signal to the first gate driving circuit;

a third clock line which transmits a third clock signal to the second gate driving circuit, the third clock signal having a first delay difference with respect to the first clock signal;

a second clock line which transmits a second clock signal to the first gate driving circuit, the second clock signal having a second delay difference with respect to the first clock signal, the second delay difference being larger than the first delay difference; and a fourth clock line which transmits a fourth clock signal to the second gate driving circuit, the fourth clock signal having a third delay difference with respect to the first clock signal, the third delay difference being larger than the second delay difference.

3. The display panel of claim 2, wherein the first stage is in the first peripheral area and has a width smaller than or equal to a pixel row width defined by a distance between the first and second gate lines, and the second stage is in the second peripheral area and has a width smaller than or equal to the pixel row width.

4. The display panel of claim 2, further comprising:

a first discharging circuit adjacent to the second stage, and including a first discharging transistor which discharges a high voltage applied to the first gate line to a low voltage; and a second discharging circuit adjacent to the first stage, and including a second discharging transistor which discharges a high voltage applied to the second gate line to a low voltage.

5. The display panel of claim 4, wherein the first stage and the second discharging transistor are in the first peripheral area and have a width smaller than or equal to a pixel row width defined by a distance between the first and second gate lines, and the second stage and the first discharging transistor are in the second peripheral area and have a width smaller than or equal to the pixel row width.

6. The display panel of claim 1, wherein the pixels includes a plurality of red pixels, a plurality of green pixels and a plurality of blue pixels, one of the first and second gate lines is electrically connected to each of the red pixels and the other of the first and second gate lines is electrically connected to each of the green pixels, and each of the first and second gate lines is electrically connected to the blue pixels.

7. The display panel of claim 6, wherein each of the pixels included in a pixel column is electrically connected to the first gate line or the second gate line.

8. The display panel of claim 7, wherein first and second pixels in a single pixel row and between two data lines adjacent to each other are electrically connected to the same one data line of the two adjacent data lines, and one of the first and second gate lines is electrically connected to the first pixel and the other of the first and second gate lines is electrically connected to the second pixel.

9. The display panel of claim 1, wherein seventh and eighth pixels included in the second pixel row between the (m−1)-th data line and the m-th data line are electrically connected to the (m−1)-th data line, ninth and tenth pixels included in the second pixel row between the m-th data line and the (m+1)-th data line are electrically connected to the m-th data line, and eleventh and twelfth pixels included in the second pixel row between the (m+1)-th data line and the (m+2)-th data line are electrically connected to the (m+1)-th data line.

10. The display panel of claim 9, wherein the seventh, ninth and twelfth pixels of the second pixel row are electrically connected to the first gate line at a first side of the second pixel row, and the eighth, tenth and eleventh pixels of the second pixel row are electrically connected to the second gate line at a second side of the second pixel row.

11. The display panel of claim 7, wherein the each data line is electrically connected to each of first and second pixels adjacent to each other in a single first pixel row, and is between the first and second pixels, and one of the first and second gate lines is electrically connected to the first pixel of the first pixel row and the other of the first and second gate lines is electrically connected to the second pixel of the first pixel row.

12. A display panel comprising:

a display area;

a plurality of pixels which is disposed in the display area, and includes a plurality of pixel rows and a plurality of pixel columns;

a plurality of data lines which extends in a column direction, and comprises an (m−1)-th data line, an m-th data line, an (m+1)-th data line and an (m+2)-th data line which are sequential, where m is a natural number;

a first gate line which extends in a row direction, and is at a first side of each of the pixel rows; and a second gate line which extends in the row direction, and is at a second side of the each of the pixel rows opposite to the first side, wherein the m−1-th data line is electrically connected to seventh and eighth pixels of a second pixel row at opposing sides of the (m−1)-th data line, the m-th data line is electrically connected to ninth and tenth pixels of the second pixel row at opposing sides of the m-th data line, the (m+1)-th data line is electrically connected to eleventh and twelfth pixels of the second pixel row at opposing sides of the (m+1)-th data line, first, fourth and sixth pixels of the first pixel row are electrically connected to the first gate line at the first side of the first pixel row, and second, third and fifth pixels of the first pixel row are electrically connected to the second gate line at the second side of the first pixel row.

13. The display panel of claim 12, wherein the (m−1)-th data line is electrically connected to seventh and eighth pixels of a second pixel row at opposing sides of the (m−1)-th data line, the m-th data line is electrically connected to ninth and tenth pixels of the second pixel row at opposing sides of the m-th data line, and the (m+1)-th data line is electrically connected to eleventh and twelfth pixels of the second pixel row at opposing sides of the (m+1)-th data line.

14. The display panel of claim 13, wherein the seventh, tenth and twelfth pixels of the second pixel row are electrically connected to the first gate line at the first side of the second pixel row, and the eighth, ninth and eleventh pixels of the second pixel row are electrically connected to the second gate line at the second side of the second pixel row.

15. A display apparatus comprising:

a display panel including:

a display area;

a peripheral area which surrounds the display area and includes a first peripheral area, and a second peripheral area opposite to the first peripheral area;

a plurality of pixels in the display area and including a plurality of pixel rows and a plurality of pixel columns, a plurality of data lines which extends in a column direction, and comprises an (m−1)-th data line, an m-th data line, an (m+1)-th data line and an (m+2)-th data line which are sequential, where m is a natural number, a first gate line which extends in a row direction and is at a first side of each of the pixel rows, a second gate line which extends in the row direction and is at a second side of each of the pixel rows opposite to the first side, first gate driving circuit in the peripheral area and including a first stage which provides a gate signal to the first gate line, second gate driving circuit in the second peripheral area and including a second stage which provides the gate signal to the second gate line; and a printed circuit board which is electrically connected to the display panel, and has a main driving circuit mounted on the printed circuit board, wherein the main driving circuit generates a first clock signal, a second clock signal, a third clock signal and a fourth clock signal which are provided to the first and second gate driving circuits, wherein first and second pixels included in a first pixel row between the (m−1)-th data line and the m-th data line are electrically connected to the m-th data line, third and fourth pixels included in the first pixel row between the m-th data line and the (m+1)-th data line are electrically connected to the (m+1)-th data line, fifth and sixth pixels included in the first pixel row between the (m+1)-th data line and the (m+2)-th data line are electrically connected to the (m+2)-th data line, first, third and sixth pixels of the first pixel row are electrically connected to the first gate line at the first side of the first pixel row, and second, fourth and fifth pixels of the first pixel row are electrically connected to the second gate line at the second side of the first pixel row.

16. The display apparatus of claim 15, wherein the printed circuit board comprises:

a plurality of first signal lines which transmits the first and second clock signals to the first gate driving circuit;

a plurality of second signal lines which transmits the third and fourth clock signals to the second gate driving circuit; and a resistor-capacitor control part controlling a resistor-capacitor time constant of the first and second signal lines.

17. The display apparatus of claim 15, wherein the pixels includes a plurality of red pixels, a plurality of green pixels and a plurality of blue pixels, and one of the first and second gate lines is electrically connected to each of the red pixels, the other of the first and second gate lines is electrically connected to each of the green pixels, and each of the first and second gate lines is electrically connected to the blue pixels.

* * * * *